US005760374A

United States Patent [19]

Schippers et al.

[11] Patent Number: 5,760,374

[45] Date of Patent: Jun. 2, 1998

[54] HEATING APPARATUS FOR AN ADVANCING YARN

[75] Inventors: Heinz Schippers; Karl Bauer; Johannes Bruske, all of Remscheid; Martin Fischer, Solingen; Benno Frank, Wuppertal; Siegfried Morhenne, Breckerfeld; Ralf Dedeken, Witten; Herbert Streppel, Remscheid, all of Germany

[73] Assignee: Barmag AG, Remscheid, Germany

[21] Appl. No.: 351,273

[22] PCT Filed: Jun. 4, 1993

[86] PCT No.: PCT/EP93/01417

§ 371 Date: Mar. 9, 1995

§ 102(e) Date: Mar. 9, 1995

[87] PCT Pub. No.: WO93/25739

PCT Pub. Date: Dec. 23, 1993

[30] Foreign Application Priority Data

| | | | |
|---|---|---|---|
| Jun. 6, 1992 | [DE] | Germany | 42 18 809.1 |
| Jul. 10, 1992 | [DE] | Germany | 42 22 631.7 |
| Aug. 25, 1992 | [DE] | Germany | 42 28 129.6 |
| Sep. 24, 1992 | [DE] | Germany | 42 32 066.6 |
| Oct. 7, 1992 | [DE] | Germany | 42 33 731.3 |
| Nov. 3, 1992 | [DE] | Germany | 42 37 092.2 |
| Nov. 23, 1992 | [DE] | Germany | 42 39 301.9 |
| Dec. 24, 1992 | [DE] | Germany | 42 44 124.2 |

[51] Int. Cl.[6] ..... F27D 11/02; F27B 9/14; D02J 13/00; D01H 7/46

[52] U.S. Cl. ..... 219/388; 392/417; 57/284

[58] Field of Search ..... 219/388, 469, 219/470, 471; 392/417; 57/282, 284

[56] References Cited

U.S. PATENT DOCUMENTS

| | | | |
|---|---|---|---|
| 3,420,983 | 1/1969 | McCard | 219/388 |
| 3,559,965 | 2/1971 | Ishida et al. | 263/3 |
| 4,027,467 | 6/1977 | Smith | 57/284 |
| 4,567,721 | 2/1986 | Kuroda et al. | 57/284 |
| 5,138,829 | 8/1992 | Tanae et al. | 57/288 |
| 5,148,666 | 9/1992 | Bauer et al. | 57/290 |
| 5,193,293 | 3/1993 | Gabalda et al. | 34/68 |
| 5,313,776 | 5/1994 | Humbrecht et al. | 57/287 |
| 5,332,882 | 7/1994 | Gabalda et al. | 219/388 |
| 5,353,583 | 10/1994 | Tanae et al. | 57/288 |
| 5,404,705 | 4/1995 | Yanagihara et al. | 57/290 |

FOREIGN PATENT DOCUMENTS

| | | |
|---|---|---|
| 0 332 227 | 9/1989 | European Pat. Off. . |
| 0 412 429 | 2/1991 | European Pat. Off. . |
| 0 442 368 | 8/1991 | European Pat. Off. . |
| 1 204 634 | 1/1960 | France . |
| 1 937 492 | 2/1970 | Germany . |
| 1 303 384 | 10/1971 | Germany . |

*Primary Examiner*—Tu B. Hoang
*Assistant Examiner*—J. Pelham
*Attorney, Agent, or Firm*—Bell Seltzer Intellectual Property Law Group of Alston & Bird LLP

[57] ABSTRACT

An apparatus for heating an advancing thermoplastic yarn led over heating ridges along a heated surface. An essential feature of the invention is that the heating ridges can be maintained at a temperature as high as that of the heating surface, in particular at a temperature sufficient for ensuring a self-cleaning effect, without damaging the yarn. If required, the heat flow on the yarn may also be regulated by adjusting the height of the heating ridges and/or by modifying the length of contact with the yarn.

29 Claims, 16 Drawing Sheets

HEATING APPARATUS FOR AN ADVANCING YARN

BACKGROUND OF THE INVENTION

The invention relates to a heating apparatus, in particular an elongate body, such as a tubular heater for heating an advancing yarn.

Such a heating apparatus is used, for example in a false twist crimping machine.

Apparatus for heating synthetic yarns in false twist crimping machines are known. In general, they comprise heating rails arranged in elongate heating chambers, which are heatable to a certain temperature, and over which the yarn can be guided in that it advances over yarn carriers, so-called ridges, so as to be heated.

For drawing and thermosetting synthetic yarns, tubular yarn guide members are known. For example, DE-AS 13 03 384 describes a guide member, which is looped by the yarn. This yarn guide member has a rotationally symmetric configuration and is provided with a bead at its yarn contact end. It can be heated from its yarn contact end toward its yarn runoff end to temperatures increasing continuously from a yarn drawing temperature to a yarn setting temperature, and be configured and arranged such that it can be looped by the yarn in a steep coil. This yarn guide member is complicated in its structure, and requires for its manufacture a plurality of costly operations. In addition, it is expected not to operate with the reliability to be met by high-speed processes.

In modern false twist crimping processes, the yarns advance at a considerable speed. The temperatures prevailing in the heating chambers are therefore accordingly high, which may result in damage to the yarn, when it contacts the heated surfaces of the heater. Furthermore, it is difficult to provide a uniform level of the yarn path over the heated surface, especially in curved heating chambers, in a simple manner, which ensures that the advancing yarn is heated without damage. Moreover, the known heating devices do not permit a modification of the predetermined curvature or length of a yarn path without great expenditure.

Since such heating apparatus are also used in the treatment and processing of film tapes and filaments, the latter will always be included, when in the following reference is made to a yarn.

A thermoplastic material for the yarn includes in particular polyamide or polyethylene therephthalate (PA 6, PA 6.6), but is not limited thereto.

It is the object of the invention to provide a heating apparatus, which allows to operate all structural components at high temperatures, and to make effective use in particular of the selfcleaning effects.

SUMMARY OF THE INVENTION

The above and other objects and advantages of the present invention are achieved by the provision of a yarn heating apparatus which comprises an elongate heating surface, means for heating the heating surface, and yarn guide means comprising a plurality of yarn carriers mounted in a longitudinally spaced apart arrangement along the length of the heating surface. The yarn carriers define relatively short axial ranges which directly contact the yarn and thereby directly heat the yarn, and axial ranges between the yarn carriers which are not in contact with the yarn and wherein the yarn is heated by radiation. Also, the yarn carriers are thermally connected to the heating surface and constructed so that in operation they assume approximately the same temperature as that of the heating surface.

By the described configuration of the yarn carriers and a close thermal bonding of the yarn carriers to the heating surface, it has been found that the heating surface and the yarn carriers may be maintained at a relatively high temperature during operation, preferably at a temperature above that necessary for self cleaning, without damaging the yarn.

As a surprise, it has been found that a danger of burning does not exist for the yarn at high temperatures and thin yarns, even when, as is further proposed to be advantageous, the height of the yarn carriers is selected from about 0.1 mm to 5 mm, preferably from 0.5 mm to 3 mm. The lower limit is predetermined by the curvature of the heating surface and the slope of the helix, along which the yarn is guided, or the curvature of the heating surface, as well the spacing between successive yarn carriers, and must be selected such that the yarn does not contact the heating surface itself.

The following should be pointed out: both the fact that yarn carriers and the heating surface have a particularly good heat contact, and the fact that the ridges have only a small height relative to the heating surface, represent, each for itself as well as jointly, a significant improvement over the state of the art. These improvements can be used with advantage in any type of high temperature heater, in which the yarn is advanced over the heating surface along a curved threadline. A particularly good heat contact may also be realized, when heating surface and yarn carriers are made integral, or by yarn guides in a highly heat conductive arrangement.

It is also a further object of the invention to provide a yarn heating apparatus, which, in the presence of the aforesaid properties, permits to influence in addition the heat transfer to an advancing yarn in each case of application. This means, the invention is intended to provide likewise a yarn heating apparatus, which enables temperature profiles within wide limits in accordance with the necessary heat transfer conditions. In particular, the invention is to provide for a heating apparatus, which allows to make changes both in the curvature and in the length of the yarn path and surface traversed or contacted by the yarn.

A relative movement of the yarn guides arranged at the inlet and outlet end of the yarn path allows to change not only the length of the yarn path, but a correspondingly variable width and/or height of the axial regions on the heating surface, which are operative as yarn carriers, permits to change, in a controllable manner, also the temperature profile of the heat transfer that is operative on the yarn.

Yarn guide ridges that are variable in width permit to vary the dwelling time of a yarn on the heating surface. This means that as the heated surface, which is contacted by the yarn, is varied in its size, the heat transferred to the yarn is changed likewise. In addition, a corresponding variation of the contactfree zones extending between the ridges allows to also control the profile of the heat transfer. A further possibility of variation is given by height-adjustable ridges, which allow to adjust uniformly or variably the spacing between the heating surface per se and the yarn path.

In a preferred embodiment, the heater is a tube, on which rings or disks are inserted for use as yarn guide ridges. The circumferential surfaces of these rings serve as yarn contact or yarn guide surfaces and effect the heat transfer to the yarn advancing thereover. Over their circumference, the rings may have an even or continuous or a stepwise variable width and/or height. The axial spacing between them may be constant and invariable, or it may increase or decrease or be otherwise variable in direction of the advancing yarn.

It should be expressly pointed out that it is possible to adapt the heating surfaces, which are here illustrated by way of tubes, in their form to the particular requirements. Thus, it is also possible to apply the teaching of the invention in connection with flat or grooved heaters.

The rings may be spaced apart from one another by grooves cut into the surface of the heater, or they may be arranged on the surface stationarily or adjustably.

The lengths of yarn passage may be varied, in that in direction of the advancing yarn, directly preceding or following the heater, yarn guides are provided, which are adjustable in their position relative to the heater and/or to one another. If need arises, however, these yarn guides may also be provided at the inlet end and outlet end of the heater itself.

Otherwise, with respect to exemplified forms and adjustment possibilities of the yarn guides reference should be made to the description.

In particular, it should be noted that the heating apparatus of this invention may be operated in a temperature range, which corresponds to the selfcleaning temperature of the heated surface.

In this connection, the invention avails itself of the recognition that the selfcleaning temperature is in the order of approximately 430° C., and that the influencing of the heat transfer from the heated surface to the yarn being heated subjects the yarn to a lesser temperature of, for example, 350° C.

These measures are advantageous, especially when thermoplastic yarns of a lower denier, for example 20 deniers, advance through the heating apparatus of the present invention, for example, at a yarn speed of about 1000 meters per minute.

In practice, these measures allow to prevent the heated surface from being gradually covered as a result of continuously forming sediments from the advancing yarn. Thus, it is possible to maintain the heating conditions of the advancing yarn substantially constant over the entire yarn length.

This possibility offers itself, especially when a heating apparatus is provided for several yarns to be heated. In this instance, during the cleaning phase of one of the yarn heating zones, the other yarn is allowed to advance continuously in its associated yarn heating zone, without it being possible that the selfcleaning of the first yarn heating zone affects the quality of the yarn that continues to advance in the second heating zone.

Likewise, it may be useful to rotate or move the yarn heating zones below the advancing yarn at certain time intervals, so as to obtain a regular selfcleaning of the yarn heating zones.

In the following, among other things, a special embodiment of the invention is described in more detail, which is employed as a heating apparatus for a false twist crimping machine.

This heating apparatus is described in EP 0 412 429 A2. The advantage of this heating apparatus lies, on the one hand, in its high heating performance, which is transferrable to the yarn, and allows a short length of the heater. The other advantage is its selfcleaning effect.

It has been found that this selfcleaning effect varies over the length of the heater.

A further object of the invention with respect to this special embodiment consists of perfecting the known heater such that it is not necessary to clean the heater from caked or cracked residues of the thermoplastic yarn material.

In a special embodiment of the invention, the heater may comprise an inlet zone, in which the yarn has only a slight or no contact with the yarn carriers as a result of spacing the yarn carriers widely apart from one another. Preferably, the inlet zone is provided with only one inlet yarn guide, and the outlet zone has only one outlet yarn guide. Moreover, it shows to be advantageous, when the inlet yarn guide remains unheated. For this reason, it is suggested that the inlet yarn guide has no heat contact with the heating surface. As a result, the yarn guide remains essentially unheated, so as to prevent thermoplastic material from separating. The yarn guide at the outlet end should, however, have a self-cleaning effect. It is therefore connected, preferably directly, with the heating surface, and arranged at the beginning of the so-called "control zone," which follows the inlet zone.

The control zone is the section, in which the yarn is brought to its desired temperature. The control zone accommodates several yarn carriers. These yarn carriers are spaced apart from one another equally or variably, as is described in the above-referenced EP 0 412 429 A2 publication.

The use of yarn carriers in the control zone allows to ensure that the yarn is guided at an exactly defined distance from the heating surface. To ensure moreover that in the inlet zone, the yarn does not come into contact with the heating surface, it is also suggested that the heating apparatus be provided with a stepped portion between the inlet zone and control zone, so that in the inlet zone, the spacing between the heating surface and the yarn path is greater, preferably amounts to a multiple of that distance which the yarn path assumes from the heating surface in the control zone.

For improving the selfcleaning properties, it is further provided that the yarn carriers are mounted on the heating surface as ridges and have a highly heat-conductive contact. It may further be provided the ridges and the heating surface are made of one piece, i.e., that the heating surface consists of ridges and recesses alternating therewith. Each of these measures is suitable and destined to ensure that the ridges are heated to the same high temperature as the heating surface, i.e., to temperatures, which are higher than 300° C. to 350° C.

The arrangement of the yarn carriers in accordance with the invention ensures that the yarn guides are arranged only in the zone, in which the selfcleaning is guaranteed on the one hand as a result of the temperature assumed by the yarn, and on the other hand by the heater temperature. In the control zone, the temperature of the heating apparatus is accurately controlled, preferably by a control system. The precise guidance of the yarn relative to the heating apparatus allows to ensure in this zone that the yarn assumes a predetermined desired temperature. In so doing, the variable widths of the yarn carriers with respect to an advancing yarn allow to vary the so-called dwelling time of the yarn within wide ranges, when the yarn carriers are movable, i.e., the contact surface between yarn and yarn carrier is adjusted as a function of the temperatures measured on the yarn or on the heater. In the inlet zone, a precise guidance of the yarn is not needed. In this instance, use is made of the recognition that in the inlet zone, the heating of the yarn occurs with great temperature gradients between the heating apparatus and the yarn and, therefore, an accurate temperature control of the yarn is neither wanted nor possible.

The heating of the yarn in the control zone causes that, at first, the outer layers of the yarn assume the desired temperature. Required however is a uniform heating of the yarn over its entire cross section. This goal is achieved in that the control zone is followed by an outlet zone, in which the yarn carriers are again arranged widely spaced apart, or that they are absent. To prevent the yarn from coming into contact with the heating surface of the heating apparatus, it is also preferred in this zone that the spacing between the yarn path and the heating surface is greater, preferably by a multiple of the spacing which the yarn path and the heating surface assume in the control zone. This arrangement of the outlet zone ensures that, due to only a slight heat transfer,r heat losses are prevented, and the heat supplied in the control zone is distributed evenly over the entire cross section of the yarn.

In the inlet zone, it is possible to accept a great, unsupported length of the yarn, since it has shown that in the inlet zone, the tendency of the yarn to vibrate is small. A length of 400 mm to 500 mm is possible. However, for limiting expenditure, the length should be increased to the extent that is necessary for achieving the desired preheating of the yarn.

The outlet zone is, in any event, shorter than the inlet zone. The length of the outlet zone is limited preferably to 300 mm and, in particular, should be even smaller.

The spacing between yarn path and heating surface in the outlet zone and in the inlet zone is greater, preferably by a multiple of the spacing in the control zone, but is preferably also limited to 5 mm, preferably 3 mm.

Within the scope of this invention, use may be made in an especially advantageous manner of the fact that the contact length of the yarn carriers influences the heat transfer.

The optimization of the heating effect on the yarn is highly significant for the quality of the yarn and its texturing in the false twist crimping machine. For this reason, it is suggested that the contact length of the yarn guides be adjustable. As a result, it is also possible to optimize the adjustment of the heating effect on the desired yarn speed and yarn diameter (denier). To accomplish this, it will be opportune to design the heating apparatus and yarn carriers such that the latter are exchangeable.

To optimize the heating effect and to adapt same to the speed of the advancing yarn and its denier, it further suggested to be advantageous that the ratio of contact length of the yarn guidance to the contactfree length of the heating apparatus be made adjustable, in particular in the region of the control zone. A heating apparatus may have, for example, the shape of a tube, which is provided on its circumference with several ridges that widen axially in the circumferential direction. These ridges may be arranged on the circumference successively and offset from one another. This allows to accomplish that the yarn helically looping about the tube contacts the ridges, one after the other, in regions, in which the ridges have substantially the same length of contact.

A further embodiment, which allows at any time an adaptation of the heating effect to the specific process parameters, in particular yarn denier and speed of advance, consists of a heater, which can be varied in its length by combined sections.

In accordance with a further embodiment of this invention, it is possible to slip over a heating tube having a substantially smooth surface a sleeve or a cage, the inside diameter of which corresponds to the outside diameter of the heating tube, and the jacket of which contains identically shaped recesses extending therethrough in a line-by-line arrangement. In the sleeve, lines of identically shaped recesses are preferably diametrically opposed, with lines of differently shaped recesses extending preferably next to these lined-up recesses. Preferably, the lines extend axis parallel. Arranged between the lined-up recesses are identically shaped ridges corresponding to the shape of the recesses and extending over the circumference. The sleeve is secured on the heating tube against axial displacement, but may be rotated. This results on the one hand in the advantage that a gradual rotating of the sleeve on the tube allows to guide the yarn always over a clean contact point of the ridges. On the other hand, it is possible to heat the yarn within wide temperature ranges due to the different configuration of the ridges. Since in the sleeve, identically-shaped ridges and recesses are diametrically opposite, or repeat at certain angular distances, contact paths are formed for two or more yarns. Otherwise, the ridges extending between the lines in the axial direction of the sleeve have no significance for the essence of the invention.

BRIEF DESCRIPTION OF THE DRAWINGS

Embodiments of the invention, but without limiting same thereto, are illustrated in the drawing and described below in more detail.

In the drawing.

In the following description of different embodiments of the invention, like parts are identified by like numerals.

Figure 3:
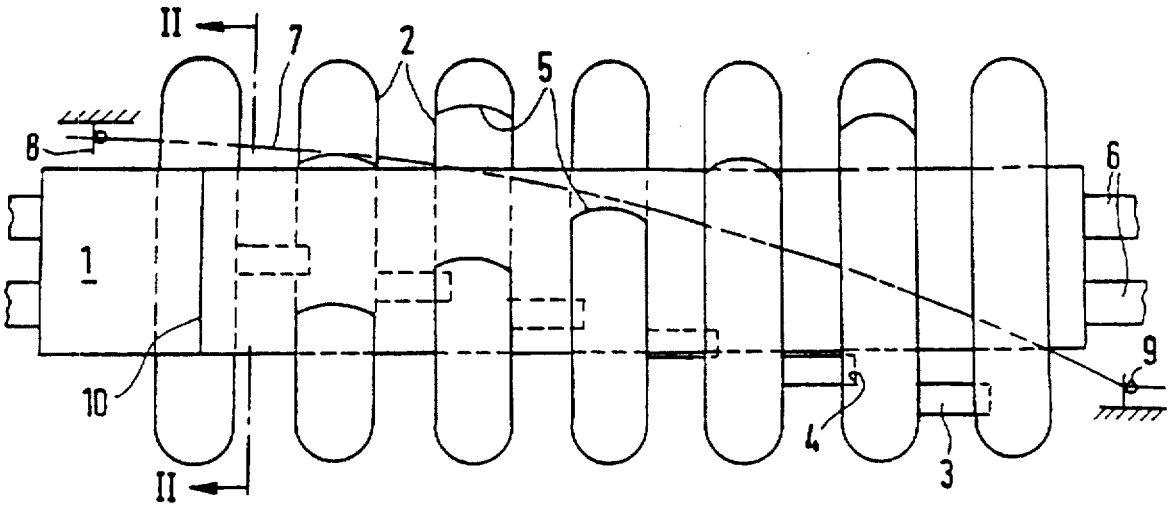
FIG. 3 is a side view of the heating apparatus in accordance with the invention.

A heating apparatus as shown in FIG. 3 consists of a tube 1, hereafter also named heating tube. The heating tube 1 accommodates in its interior two parallel extending heating resistors or elements 6, which preferably are separated from one another and from the inside surface of heating tube 1 by a suitable insulating material, such as, for example, powdered magnesium oxide or magnesium silicate. The heating tube 1 consists of a highly heat-conductive metal, such as steel or, preferably, a copper aluminum alloy.

Figure 1:
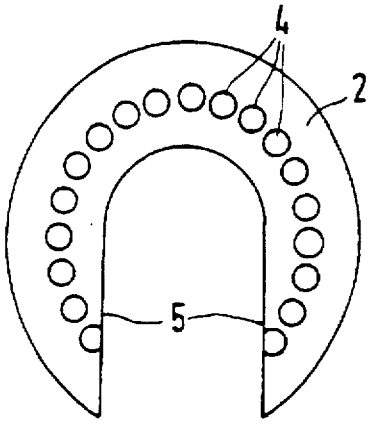
FIG. 1 is a top view of a disk in accordance with the invention, suitable for guiding a yarn.
Figure 2:
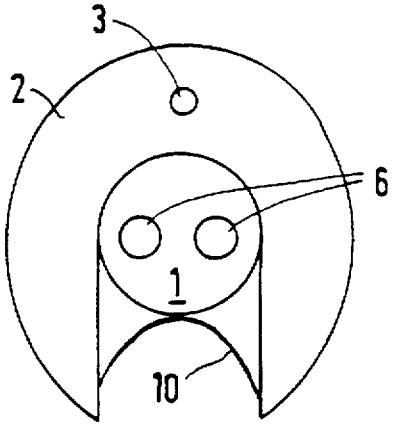
FIG. 2 is a sectional view along line II—II of FIG. 3.

Inserted on heating tube 1 is a plurality of rings or disks 2. As shown individually in FIGS. 1 and 2, these disks 2 are circular and have a radial slot 5, the inside width of which corresponds substantially to the diameter of heating tube 1, and the opposite edges of which extend parallel to one another. The outer edge of disks 2 is spherical. Arranged in the one front end of disks 2 is a plurality of cavities or recesses 4, which are equally spaced apart from one another and from the axis of disk 2. From the opposite front end of disk 2, a pin serving as a spacer extends, at a distance from the disk axis, which corresponds to the distance of recesses 4 from the disk axis.

The disks 2 are placed on heating tube 1, so that pin 3 projecting from a disk 2 engages in a recess 4 of an adjacent disk, the disks 2 being inserted on the heating tube, preferably with an even angular offset from one another, so that the openings of slots 5 and pins 3 surround the heating tube in spirals, or overlie one another in a specific pattern in the axial direction of tube 1. To secure the rings 2 on tube 1, it is possible to insert into slots 5 a spring clip 10, if need be, the legs of which lie against the opposite slot edges, and the apex of which is in contact with tube 1.

The spherical edges of disks 2 serve to guide a yarn 7, which is placed via an inlet yarn guide 8 against the yarn guide surface of the heating apparatus that is formed by the spherical edges of disks 2, and leaves the apparatus via an outlet yarn guide 9 that is angularly and axially offset from yarn guide 8. This means that yarn 7 loops about the apparatus in a spiral, the pitch or inclination of which is dependent on the offset of yarns guides 8 and 9 relative to one another. At least one of the yarn guides is rotatable relative to the other about the axis of heating tube 1, so that the length of the yarn path over disks 2 can be varied by changing the pitch of the spiral formed by yarn 7. The yarn guides 8 and 9 are positioned on both sides of slot 5, and the spiral of yarn 7 extends in the region of disks 2 outside of slots 5.

Preferably, the disks consists of a heat-resistant and nonscaling material, for example, aluminum oxide or titanium oxide. To increase the abrasive resistance of the disk edges, same may be coated, if need be, with a suitable metal, and to increase their yarn-friendliness, the disk edges may be ground or polished.

Figure 4:
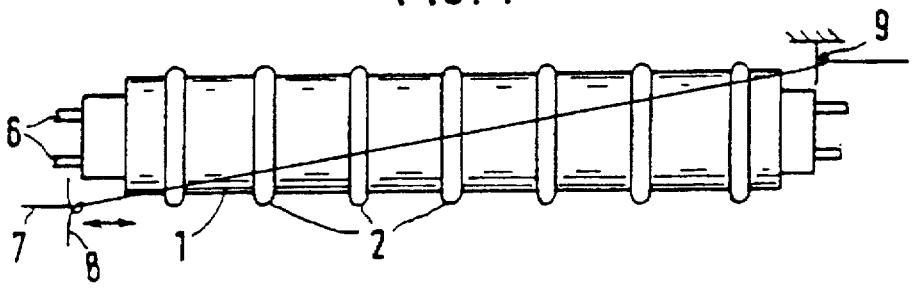
FIG. 4 is a side view of a further embodiment of the invention.

The embodiment of the invention, as shown in FIG. 4, consists of a heating tube 1, which is provided with an electric resistance heating wire 6, and surrounded by a plurality of rings 2. The rings 2 are fixedly connected to heating tube 1, for example by soldering, and they are equally spaced apart from one another. However, the rings 2 may also be formed by beads, which are formed on the tube at regular distances by upsetting. The rings may also be spaced apart from one another by grooves, which are machined out of the outer surface of heating tube 1. The radially projecting peripheral surface of rings 2 is spherical and of a yarn-friendly quality. The rings 2 serve to guide a yarn 7 at a distance over the surface of heated tube 1, the yarn path looping preferably spirally about tube 1. As schematically illustrated, at both ends of heating tube 1, yarn guides 8 and 9 are arranged, their offset from one another defining the pitch and the length of the yarn path. At least one of the two yarn guides may be adjustable relative to the other. The means necessary to adjust this yarn guide are state of the art and not shown.

Figure 5:
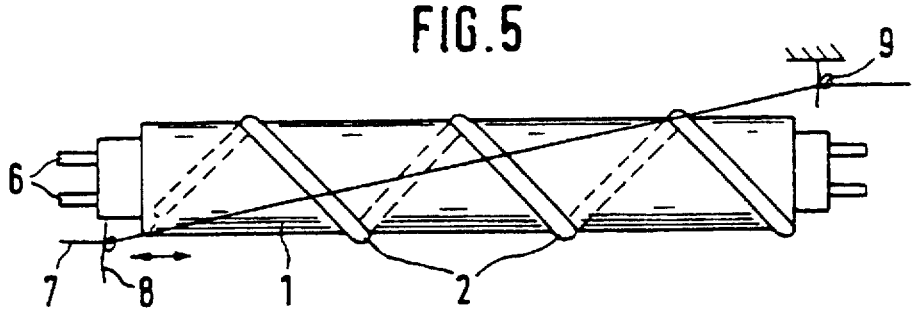
FIG. 5 is a side view of a third embodiment of the invention.

The embodiment shown in FIG. 5 consists of a heating tube 1, which accommodates in its interior an electric resistance heating wire 6, which is surrounded over its entire length by a helical yarn guide 2. The helical yarn carrier 2 is fixedly connected to tube 1, for example, by soldering. Its outwardly directed surface is spherical and of a yarn-friendly quality, i.e., it exerts a negligible friction, if possible, on the yarn advancing thereover. The yarn advances in a spiral, which is opposite to the threads of yarn carrier 2. The yarn is threaded onto the helical yarn carrier 2 by means of eyelet-shaped yarn guides 8 and 9, which are provided on the inlet and outlet ends of heating tube 1. As in the above-described embodiments, it is possible to adjust yarn guides 8, 9 relative to one another.

Figure 6:
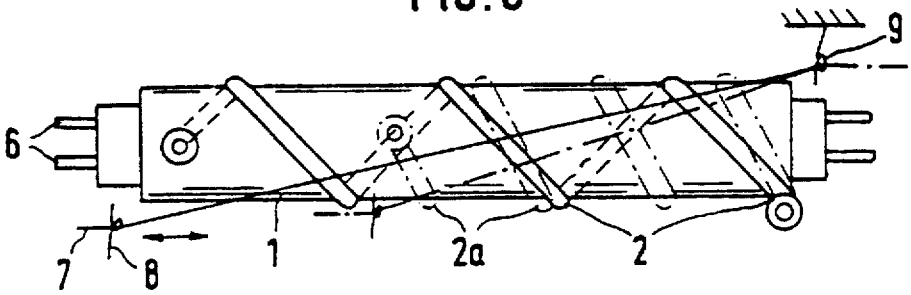
FIG. 6 is a side view of a fourth embodiment of the invention with adjustable yarn guides.

A fourth embodiment of the invention is shown in FIG. 6. Likewise, this embodiment includes a tube 1 heated by a heating resistor 6. In this instance, the tube 1 is looped by a helical yarn carrier 2, which consists of a flexible, if possible, an elastic material. For example, the yarn carrier 2 may be a small metal tube with its flat surface lying against the heating tube 1, so that an intimate heat contact is present between heating tube 1 and yarn carrier 2. The connection between yarn carrier 2 and the surface of heating tube 1 is by frictional engagement, so that the pitch of the yarn carrier 2 helically winding about heating tube 1 may be changed, in that one of its ends is displaced relative to its other on the surface, thereby changing the pitch and the length of the yarn carrying spiral. Any widenings or narrowings resulting the change in the length of the spiral can be adapted to the diameter of tube 1 by adjusting the spiral ends at the beginning of the surface of tube 1. In FIG. 6, the helical yarn carrier 2 is shown in solid lines in an extended position and in a compressed position in dash-dotted lined 2*a*. Any widenings or narrowings resulting the change in the length of the spiral can be adapted to the diameter of tube 1 by adjusting the spiral ends on the circumference of the surface of tube 1.

In this manner, it is possible to change the length of the yarn path along the heating tube. Likewise, the adjustment of yarn guides 8, 9 at the inlet and outlet ends of the heating tube allows to change in addition the pitch of the path traversed by the yarn.

The yarn contact heaters described so far offer, among other things, the advantages of enabling yarn paths that can be varied within wide ranges. Furthermore, they permit to realize variable temperature profiles over the lengths of a yarn path by the successive arrangement of several, differently heated yarn guides.

Further shown in FIGS. 7–9 and 11–15 are heating apparatus, in which an inlet yarn guide 8 and an outlet yarn guide 9 are arranged at the yarn inlet and at the yarn outlet of heating tube 1, and in which the yarn guides 8, 9 and tube 1 are rotatable relative to one another in the circumferential direction of the tube.

This may be realized either by rotatably arranged inlet and/or outlet yarn guides 8, 9 cooperating with a stationary heating tube 1, or by stationarily arranged inlet and/or outlet yarn guides 8, 9 cooperating with a heating tube 1 rotating about is longitudinal axis, or by rotatable inlet and/or outlet yarns guides 8, 9 cooperating with a rotatable heating tube 1.

Figure 7:
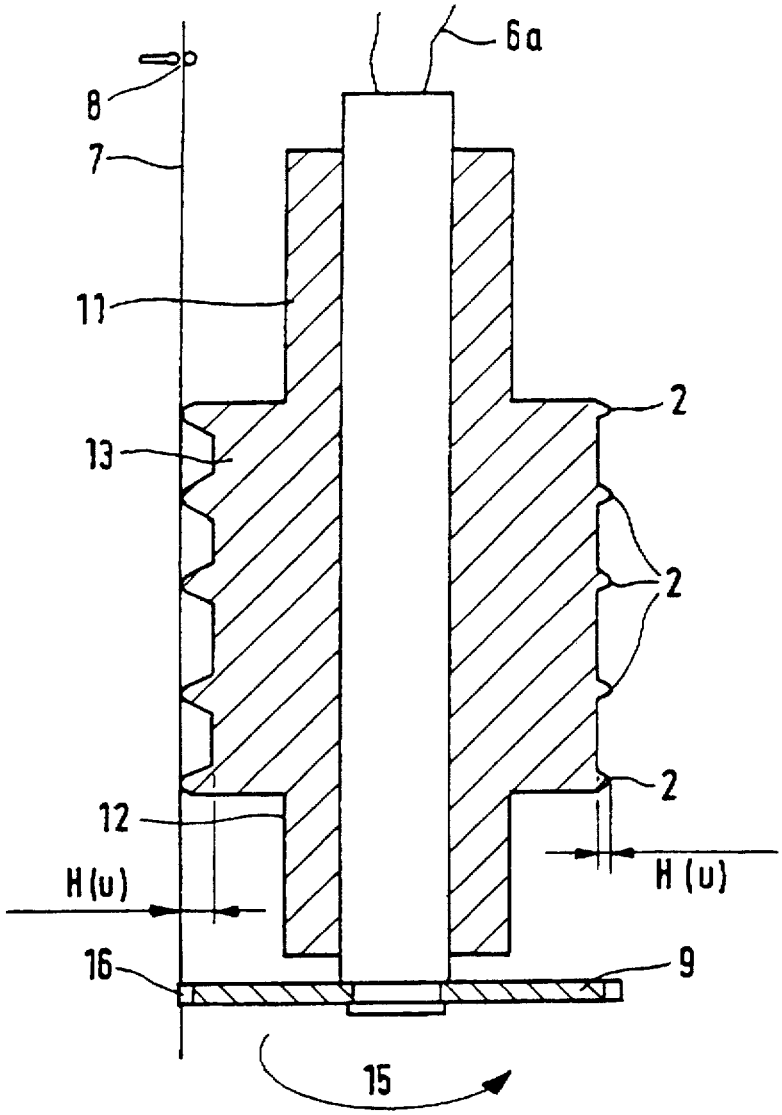
FIG. 7 is a sectional view of a heating apparatus with rings, the height of which changes in circumferential direction.

In the embodiment of FIG. 7, only outlet yarn guide 9 is rotatable relative to the tube, whereas inlet yarn guide 8 is stationary.

Figure 8:
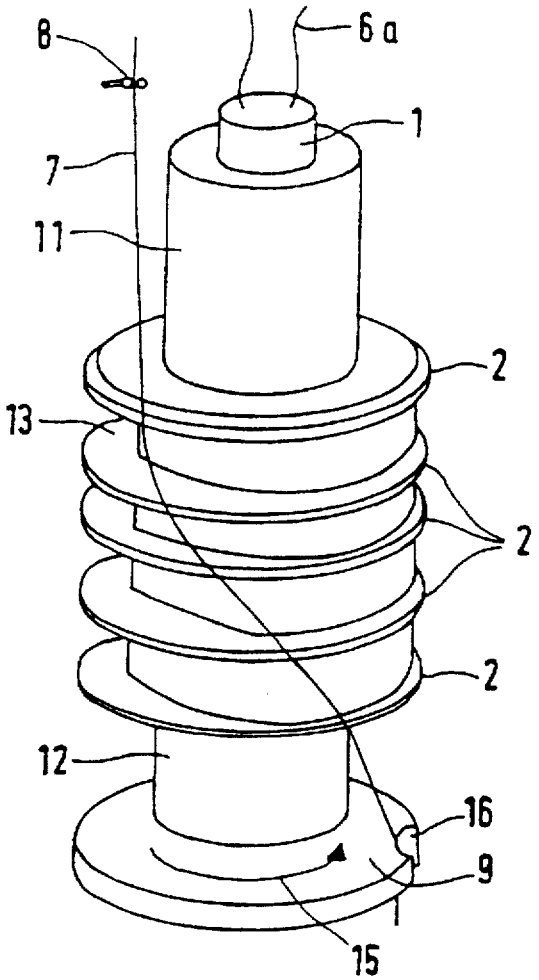
FIG. 8 is a perspective view of a heating apparatus of FIG. 7 with yarn guides rotatable relative to one another.

In the embodiment of FIG. 8, the outlet yarn guide 9 formed by a notch 16 is arranged coaxially and rotatably on the lower end of heating tube 1 and can be rotated relative to the tube in a range of rotation 15.

It is obvious that when outlet yarn guide 9 is rotated relative to the tube, the advancing yarn 7 describes a spiral on rings 2, the geometry (winding, pitch) of which is dependent on the rotated position of notch 16 in outlet yarn guide 9.

For the sake of completeness, it should be remarked that heating tube 1 has an electric resistance heating, which receives a heating current via electric supply lines 6*a*.

As is further shown in FIGS. 7–9 and 11–14, the heating apparatus may have at the inlet end of heating tube 1 and/or at the outlet end of heating tube 1, respectively an inlet zone 11 and an outlet zone 12, which occupy a greater radial distance from advancing yarn 7 than the surface of heating tube 1.

Arranged between the inlet zone 11 and the outlet zone 12 is a control zone 13, which has a further characteristic in the present instance.

Figure 9:
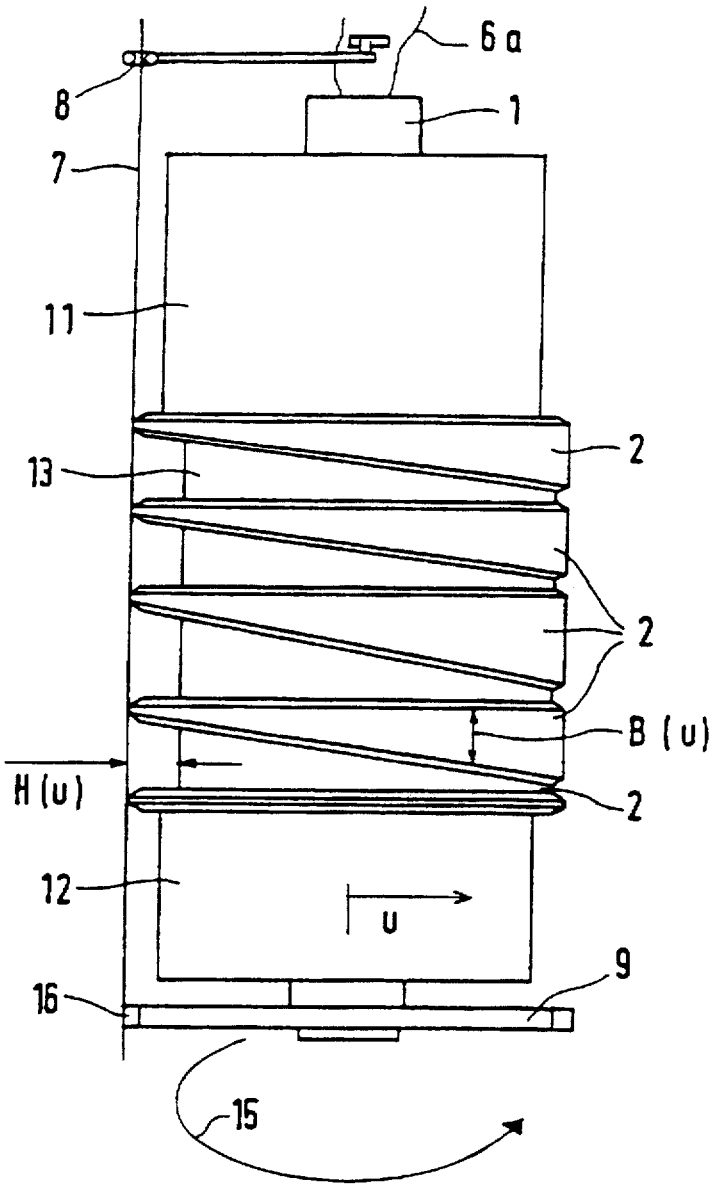
FIG. 9 is a top view of a heating apparatus with ridge widths and ridge heights changing in circumferential direction.

As can be noted to this end, among other things, from FIG. 9, the inlet yarn guide 8 and outlet yarn guide 9 are rotatable relative to heating tube 1, whereby a sector angle is formed on the surface of rings 2, which is covered by yarn 7 due to the range of rotation 15. As a result thereof, a range of possible contact surfaces forms between the yarn and the rings.

Consequently, the yarn 7 can advance along desired points within the predetermined sector angle, depending on the particular rotated position of yarn guides 8, 9 and tube 1 relative to one another.

In the sector angle covered by yarn 7, the rings have a width, which varies in circumferential direction. This means, the width B of a ring changes as a function of a circumferential coordinate u and by a function B(u), which may each time be predetermined. In this instance, the function is linear.

Further shown in FIG. 9 is the characteristic that over the possible range of contact, rings 2 have a height H which varies in the circumferential direction. This means that the height H is a function of circumferential coordinate u, which is indicated accordingly at H(u).

In the embodiment of FIG. 9, the width B of the rings increases in that circumferential direction, in which the height H of the rings decreases. One can therefore expect that as the contact time of yarn 7 on the rings increases, due to the increasing ring width B, the heat flow to the yarn increases likewise in the contactfree axial ranges between rings 2, due the to simultaneously decreasing spacing between yarn 7 and the tube surface.

Supplementing the foregoing, FIGS. 7 and 8 show that in the sector angle covered by the yarn, the rings 2 may have a height varying in the circumferential direction, when the width of rings 2, namely, the ridge width does not change in the circumferential direction.

These two embodiments of the invention may exist both in combination with one another and separately from one another.

It should further be remarked that the rings may also be formed in that annular grooves are machined out of the tube surface, so as to leave rings in accordance with the invention, over which yarn 7 advances.

In operation, heat is transferred from heating tube 1 to yarn 7, on the one hand, on the contact zones that are formed by rings 2 with yarn 7.

Furthermore, heat flows to yarn 7 in the axial ranges between rings 2 that are not contacted by the yarn. Since the bottom of the annular grooves between rings 2 has a distance from the advancing yarn of only few millimeters, for example, starting with about 0.5 mm and increasing to about 3 mm, it can be assumed, in view of the heating temperature of heating tube 1 of about 300° C. or higher, in particular temperatures in the order of the selfcleaning temperature, that a relevant flow of heat is also present in the noncontacted axial ranges.

Consequently, the flow of heat acting as a whole on the yarn becomes a function of the respectively adjusted yarn path geometry with respect to the tube geometry, since the lengths of contact and the noncontacted axial ranges are, as is the ring height, dependent on the position of inlet yarn guide 8 or outlet yarn guide 9 relative to heating tube 1.

Thus, it is possible to adjust the respectively transferred heat flow very sensitively. Already the slightest changes in the rotated positions relative to one another will effect noticeable improvements of the heat being effective as a whole on a yarn portion of a predetermined length.

The invention avails itself of this recognition by the practical example applied to a false twist texturing machine, which will be described in more detail below.

Figure 10:
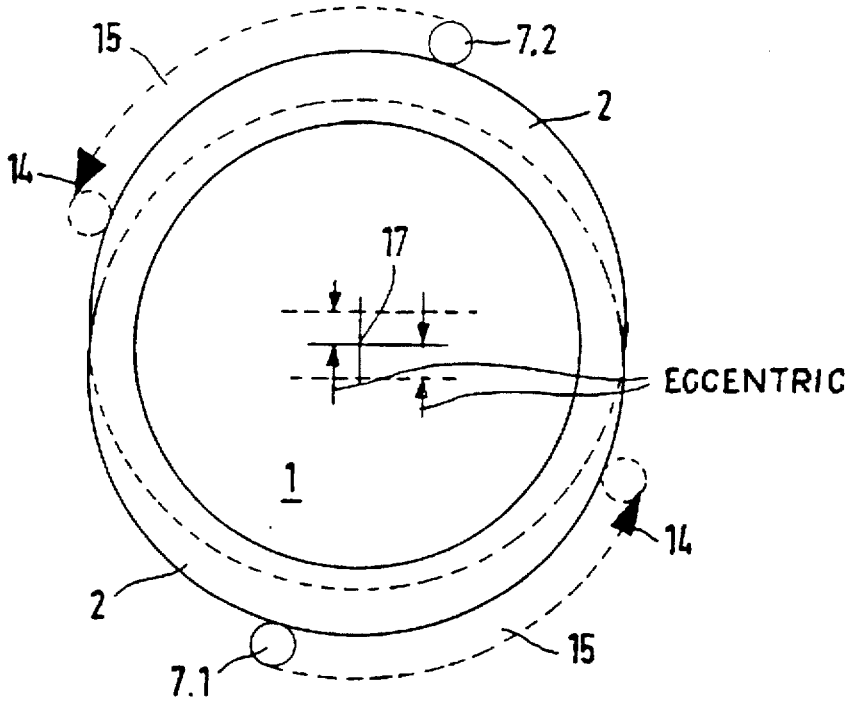
FIG. 10 is an axial top view of a heating apparatus in accordance with the invention.

As is further shown in FIG. 10, several rings 2 of this invention may be arranged off center with respect to tube axis 17, it being advantageous to offset the rings relative to one another, each in pairs, by 180°.

The last-described further development of the invention offers the additional advantage that the heating apparatus is symmetric to tube axis 17, thereby making it suitable for treating and processing a pair of advancing yarns 7.1, 7.2.

Figure 11:
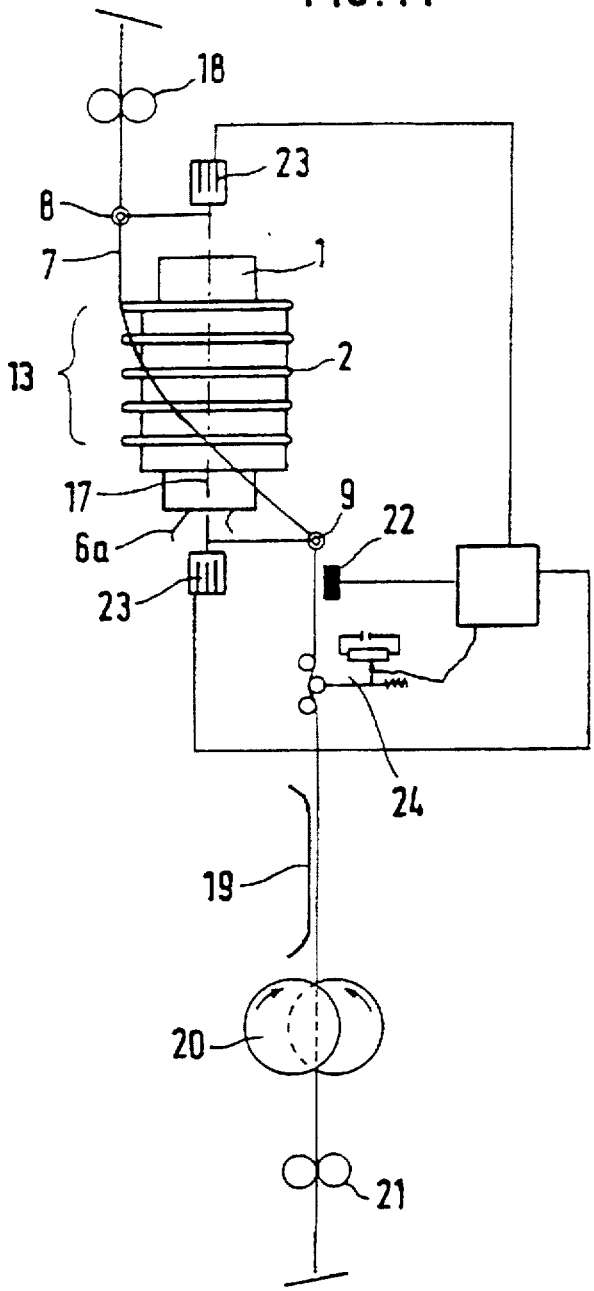
FIG. 11 illustrates an example of application in a false twist crimping machine.

Shown in FIG. 11 is a heating apparatus 13, which is preceded by feed rolls 18. Subjacent heating apparatus 13, is a cooling zone, illustrated as an elongate cooling plate 19, as well as a false twist unit 20 and feed rolls 21.

As is further shown in FIG. 11, the inlet yarn guide 8 and outlet yarn guide 9 are adjustable relative to one another or relative to heating tube 1 as a function of the yarn temperature measured at the outlet end of heating apparatus 13. To this end, a temperature sensor 22 arranged in the outlet region of heating tube 1 is used, which supplies an output signal, so as to adjust, as a function of the temperature, inlet yarn guide 8 or outlet yarn guide 9, each by means of a stepping motor 23. It should be expressly stated that the measuring signal of temperature sensor 22 may also be superposed by a yarn tension signal, which is generated by a tensiometer 24 downstream of the heating apparatus.

Among other things, the present invention offers the significant advantage that it allows to adjust the respectively effective heat transfer from the heating apparatus to the yarn extremely sensitively in the sense of a process optimization, and that moreover it allows to precisely control the yarn temperature, so as to attain an optimal yarn quality over the entire yarn length.

Figure 12:
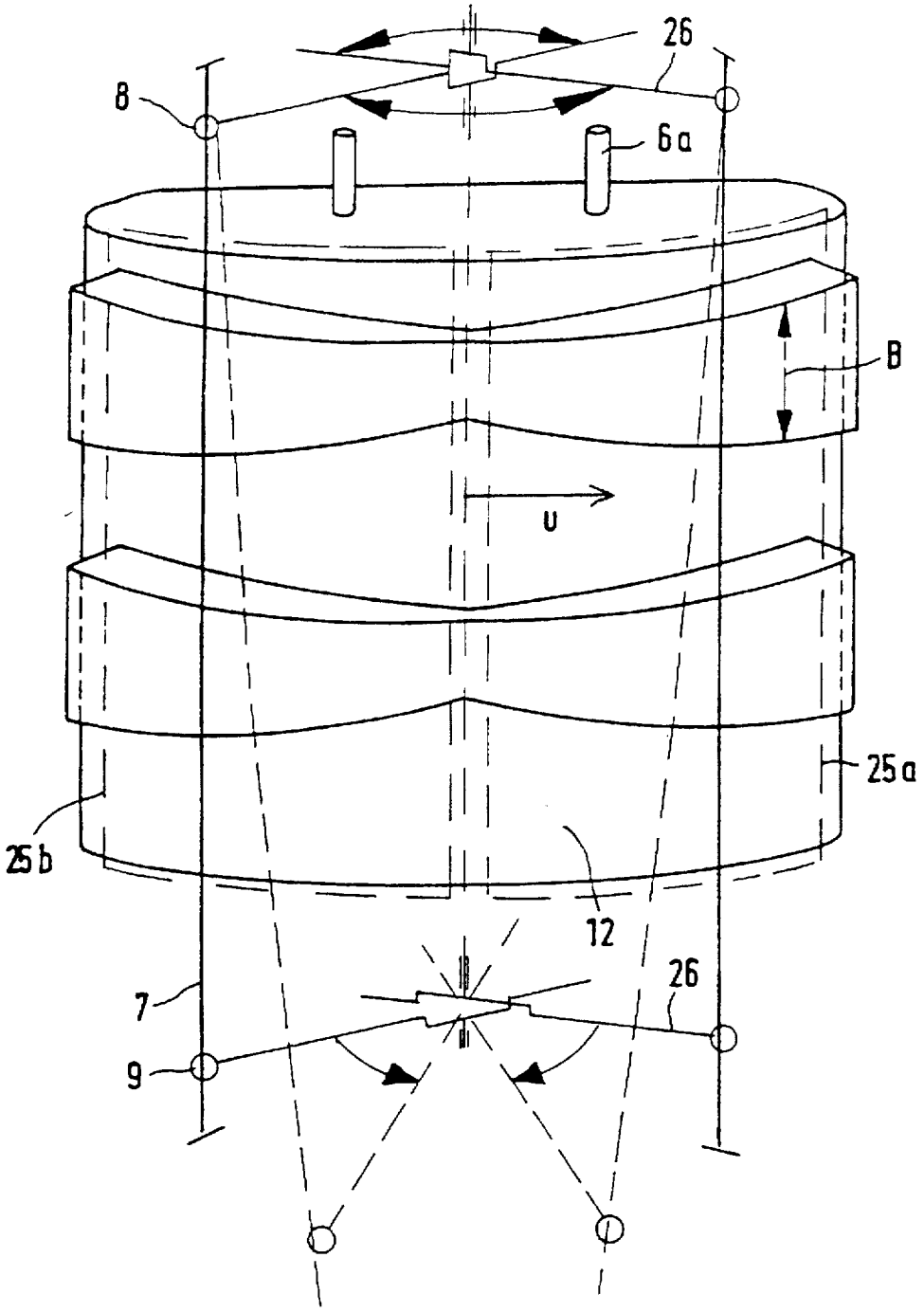
FIG. 12 illustrates a general embodiment of the invention with two identical heating zones.
Figure 13:
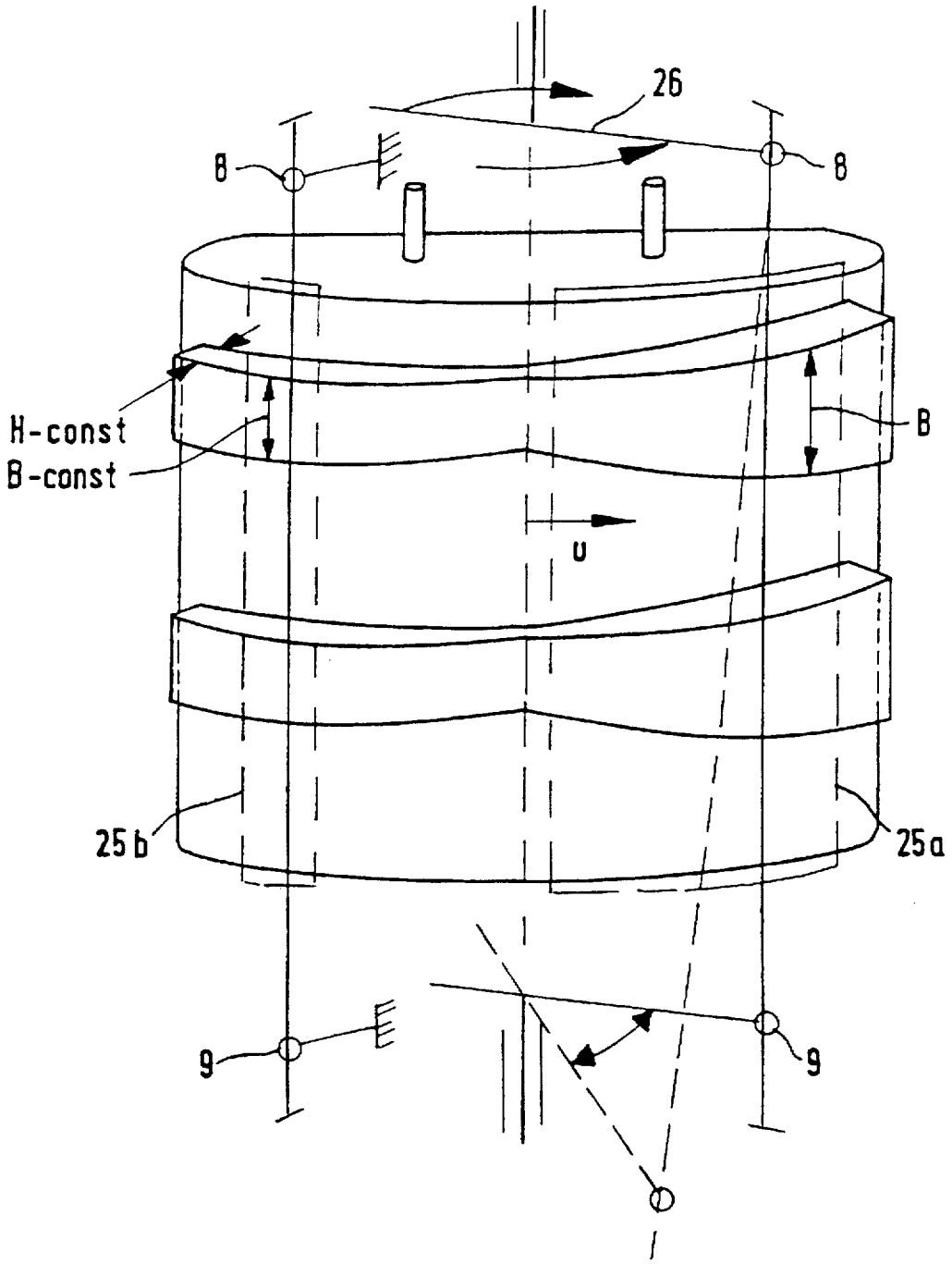
FIG. 13 illustrates a further embodiment of the invention with a nonadjustable and an adjustable yarn heating zone.
Figure 14:
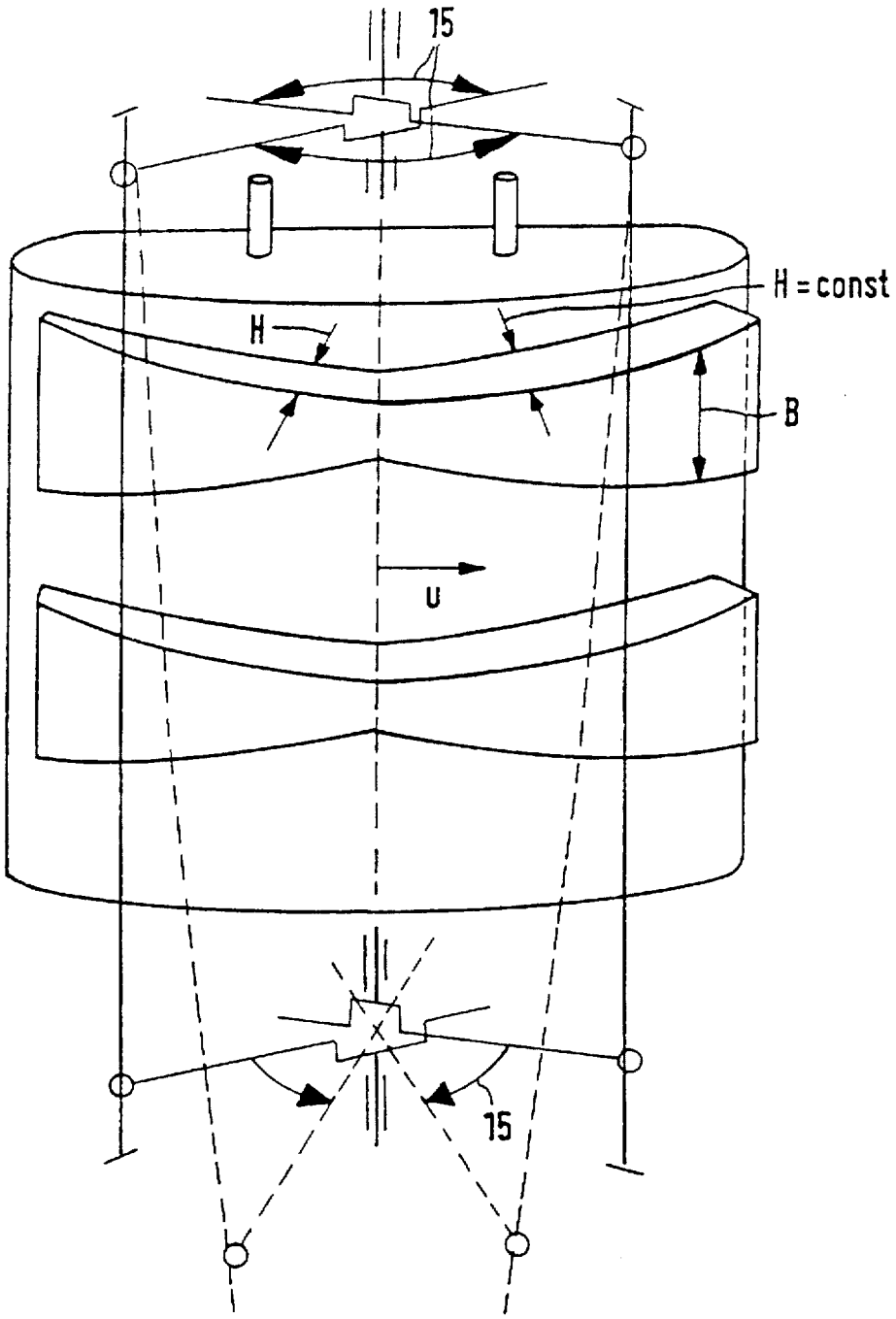
FIG. 14 illustrates a further embodiment of the invention with two differently adjustable heating zones.
Figure 15:
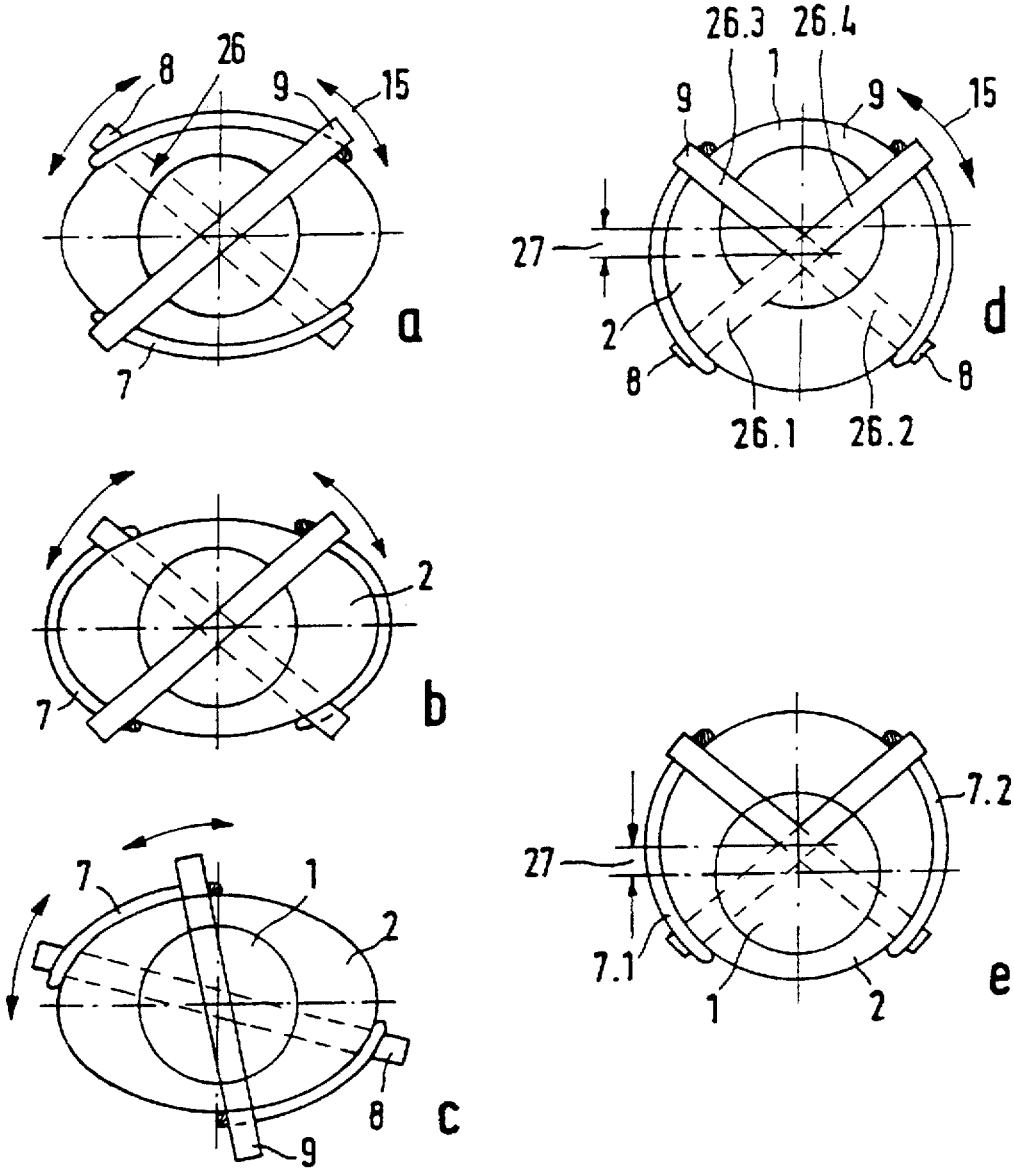
FIG. 15 illustrates axial top views of heating apparatus, each having two yarn heating zones and elliptical or eccentric rings.

Shown in FIGS. 12–14 are supplemental embodiments of the invention.

In these embodiments, without limiting the invention thereto, two yarn heating zones 25 are arranged on each heating apparatus 1.

In each of yarn heating zones 25, several ridges 2 are mounted on the heated surface transversely to the direction of the advancing yarn, the height of the ridges extending beyond the heated surface by at least 0.1 mm, however, no more than 5 millimeters.

It is important that the height of ridges 2 above the heated surface amounts to no more than about 5 millimeters, so as to make use, individually or simultaneously, of the inventive advantages of this heating apparatus, in particular its self-cleaning and its sensitive controllability.

In all embodiments, the yarn heating zone is curved convexly in direction toward the yarn, thereby making it possible to guide the yarn over the yarn heating zone along a spiral line.

The tube may be constructed as a body of rotation, a section, or a segment of a body of rotation, so as to realize in a simple manner a yarn path along a spiral line.

Within the scope of the present invention, a yarn heating zone is understood to be that range of the heating apparatus, which permits a relevant heat transfer from the heating apparatus to the yarn.

In the embodiment of FIG. 13, this may be the yarn heating zone on the left, or even a single threadline, when, for example, an adjustability of the yarn path relative to the heated surface is not provided.

However, as shown in FIGS. 12 and 14, as well as in the right-hand yarn heating zone of FIG. 13, this may also be a sector angle, in which a yarn can be guided relative to the heated surface.

As is further shown to this end in FIG. 12, it is possible to design and construct both yarn heating zones 25*a*, 25*b* identically. In this instance, without limiting the invention to this variant, it is realized that the width B of rings 2 changes in circumferential direction. More specifically, in accordance with the invention, this can be of advantage, alone or in combination with a height H of the rings that varies in the circumferential direction.

As is further shown in FIG. 13, it may also be useful to provide only one of the yarn heating zones with rings, the width B of which changes in circumferential direction, and analogously to the foregoing description, likewise their height H, whereas the ring width B in the other of the two heating zones is maintained constant.

In this instance, it will not be necessary to provide for a relative adjustability between inlet yarn guides 8 or outlet yarn guide 9 and yarn heating zone 25, since it can be presumed that the heat transfer from the heated surface to yarn 7 is constant over the entire range of the yarn heating zone.

However, it should be expressly stated that for certain applications, it may also be useful to vary the height H of the rings in circumferential direction, and that naturally it will then be useful to provide for a relative adjustability between the heated surface and the advancing yarn.

As is shown in the embodiment of FIG. 12, it will be especially useful in the presence of identical yarn heating zones, when these yarn heating zones are associated each with a synchronously movable inlet yarn guide 8 or outlet yarn guide 9, the yarn guides 8 or 9 being located in the end regions of rotatable yarn guide levers 26.

The synchronous movability is easy to realize via a corresponding gear mechanism. Such a gear mechanism, however, is state of the art, and is therefore not described in more detail.

In this manner, it is also easy to attain an identical yarn quality of two yarns advancing over the heating apparatus.

As is shown in FIGS. 15*a–e*, it is possible to arrange two yarn heating zones 25*a*, 25*b* diametrically opposite to one another, and to arrange in this instance inlet yarn guides 8 or outlet yarn guides 9 on their respective yarn guide levers 26 such that the yarns advance over locations with identical operating conditions.

It is easy to imagine that within the scope of the present invention, it will also be possible to change the width B of the rings in steps. This means that the width B is piecewise constant, and increases at certain circumferential coordinates stepwise, for example, from a smaller width to a larger width.

The foregoing statement applies likewise to a change in height H of the rings. It is intended that the invention also includes a stepwise change in the height H in circumferential direction, so as to obtain, for example, ranges of the yarn path, in which a slight lateral fluctuation of the contact zone between the yarn and ring leaves the heat transfer between the heated surface and the yarn substantially unaffected.

To this end, it may turn out to be advantageous, when rings of variable width and/or height are offset from one another in circumferential direction such that, in expectation of the possible yarn path, the respectively effective contact zones permit substantially identical contact times or yarn distances from the outer surface of the tube.

Naturally, this applies likewise to rings, the height H of which is changed stepwise.

In particular, it should be pointed out that a stepwise changing ring height H will be easy to realize, when rings are provided with sectors, each having a constant radius per sector. The zone of transition between two adjacent sectors of different radii will then have to be designed in a yarn-friendly manner, i.e., it will be necessary to round sudden or angular changes of the respective ring radius toward the adjacent ring radius in circumferential direction, so as to avoid damage to the yarn.

As is further shown in FIGS. 15*a–c*, it may be useful to make the outer contour of rings 2, at least in sections, substantially elliptical. In this instance, it is also proposed to have two yarns yarn 7 advance over opposite locations of the ellipses.

These locations may be opposite both with respect to the long axis and with respect to the short axis, as is shown in FIGS. 15*a* and 15*b*.

One of the most effective possibilities with respect to an adjustment of the yarn path, however, is shown in FIG. 15*c*, in which one of the yarns 7 advances exclusively within a quadrant extending between the long semiaxis and the short semiaxis of the ellipsis.

As one can see, in this instance the heat transfer from heating tube 1 to the yarn increases or decreases continuously over the entire yarn length between inlet yarn guide 8 and outlet yarn guide 9. In the present embodiment, a very large spacing exists between the yarn at inlet yarn guide 8 and heating tube 1, which decreases rapidly along the yarn path in direction toward outlet yarn guide 9, and assumes its smallest value at yarn guide 9, so that the heat transfer increases continuously from inlet yarn guide 8 to outlet yarn guide 9.

Thus, an extremely effective controllable heat transfer becomes possible over the entire length of the yarn advancing between inlet yarn guide 8 and outlet yarn guide 9, since the entire range of ridge 2 is available between the minimum spacing in the region of the small semiaxis of the ellipsis and the maximum spacing in the region of the long semiaxis of the ellipsis.

Within this possible line of yarn contact, it is therefore possible to expect the optimally possible heat transfer at a certain relative position between inlet yarn guide 8 and outlet yarn guide 9, a continuously increasing heat transfer from the tube to the yarn being made possible in this instance.

Consequently, in this embodiment, "two opposite locations of the ellipsis" are understood to be two circumferential areas of the ellipsis, which are diametrically opposite with respect to the intersection of the long and the short axis of the ellipsis.

Furthermore, FIGS. 15*d* and 15*e* show eccentrically arranged ridges 2. The ridges 2 are circular, the center of the circle of ridge 2 being offset from the center of circle of tube 1 by an eccentricity 27.

The inlet and outlet yarn guides for each yarn are arranged separately, each on a yarn guide lever 26, and they are circumferentially rotatable with respect to the center of ring 2 in the sense of having the same effect on the heated yarn.

In this manner, it is accomplished that upon an adjustment of the inlet yarn guides 8 or outlet yarn guides 9, the heat flow to both yarns is influenced to the same extent.

As is shown additionally in FIG. 15*e*, which illustrates a situation corresponding to FIG. 15*d*, but rotated by 180°, it is thus possible to obtain an optimal influencing of the heat transfer from heating tube 1 to yarn 7.

Whereas in FIG. 15*d*, in the region of inlet yarn guide 8, the entering yarn assumes a relatively great distance from the heated surface of heating tube 1, while the exiting yarn is at a relatively small distance therefrom, the conditions are exactly inverted in the case of FIG. 15*e*.

In the latter, the entering yarn is relatively strongly heated in the region of inlet yarn guide 8, since it assumes only a very small distance from the heated surface of heating tube 1, whereas the exiting yarn assumes a relatively great distance from the heated surface in the region of outlet yarn guide 9.

More specifically, relevant with respect to the heat transfer from the heated surface to the yarn is not only the average spacing between the heated surface and the yarn along its path between the inlet and the outlet end of the heating apparatus, but also, as is further recognized by the invention, the fact that the heat transfer from the heated surface to the yarn increases disproportionately, as the yarn approaches the heated surface.

For this reason, the rings as provided by this invention permit to operate the heated surface easily at selfcleaning temperatures, whereas the temperatures being operative on the yarn enable a heating without damage.

Furthermore, the invention makes it possible to process filament yarns of different deniers, for example 20 denier and 40 denier, respectively, with the same heating apparatus and at the same time, provided the relative position between the advancing yarn and the heated surface is adjusted accordingly.

This means that in heating apparatus having several yarn heating zones, it is also quite possible that one of the yarn heating zones is out of operation, while another yarn heating zone is in operation.

Accordingly, it is possible to realize with one and the same heating apparatus and without changing or adjusting the temperature of the heated surface, different heat flows to different yarn qualities by only selecting the relative position between the yarn path and the heating apparatus.

Figure 16:
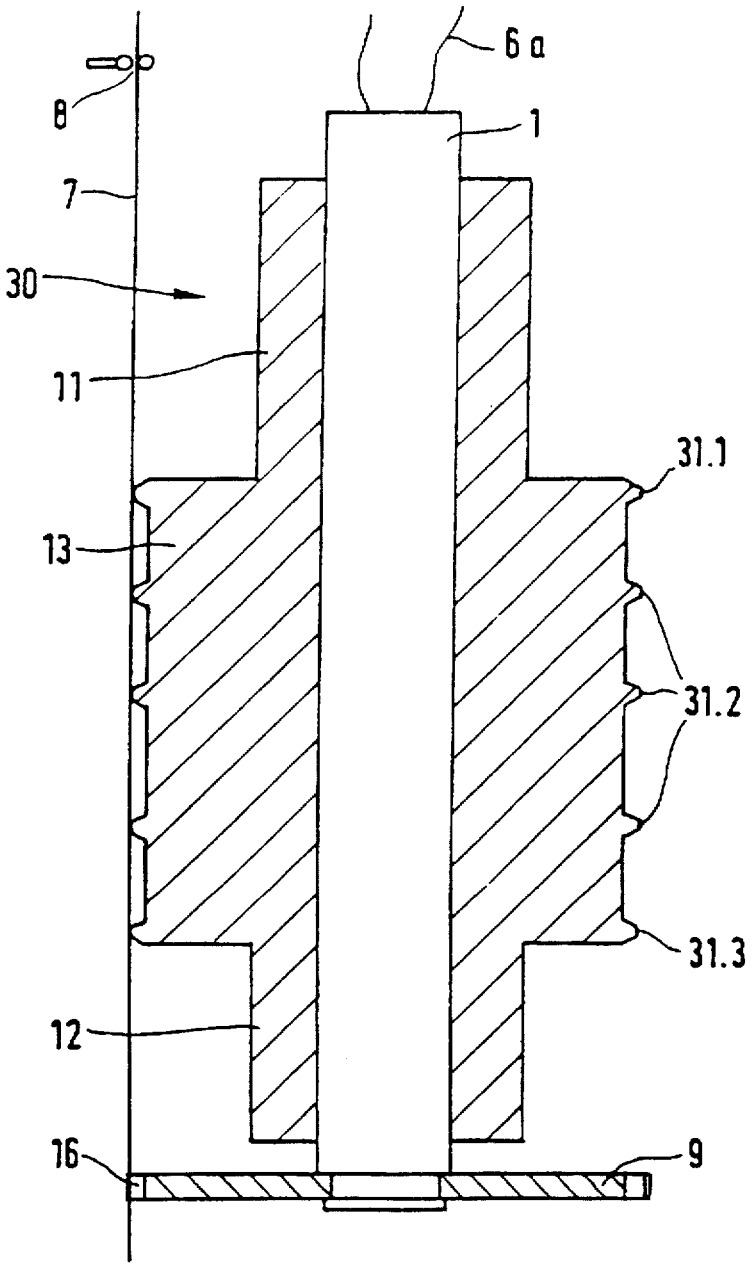
FIG. 16 is a further axial sectional view.
Figure 17:
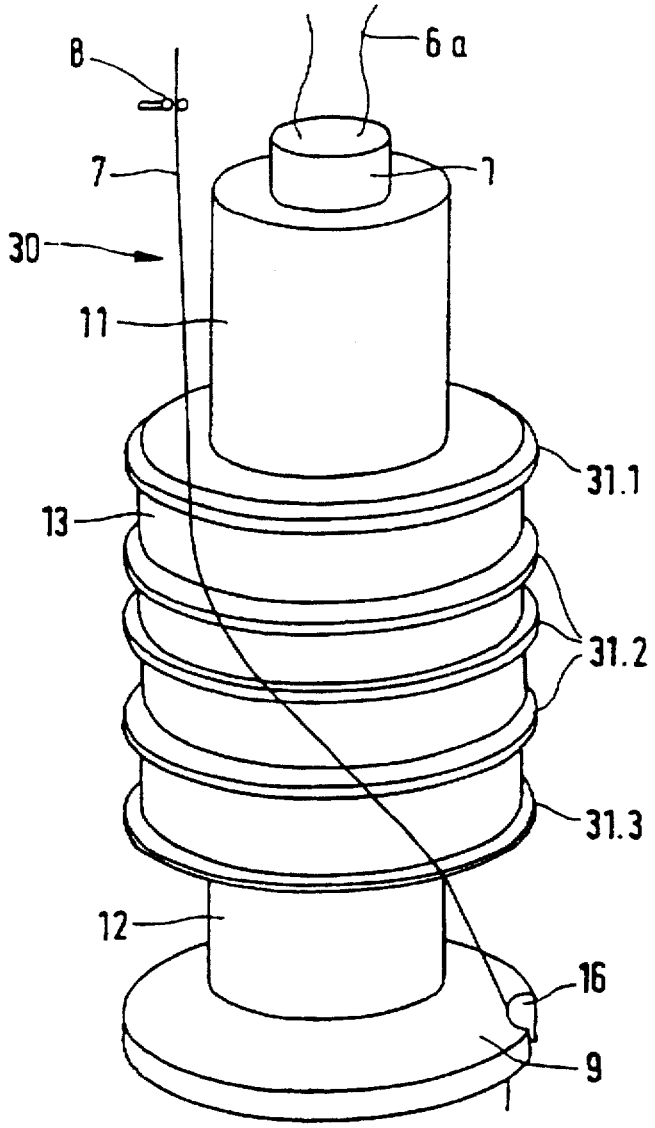
FIG. 17 is a perspective view of a tubular heater.
Figure 18:
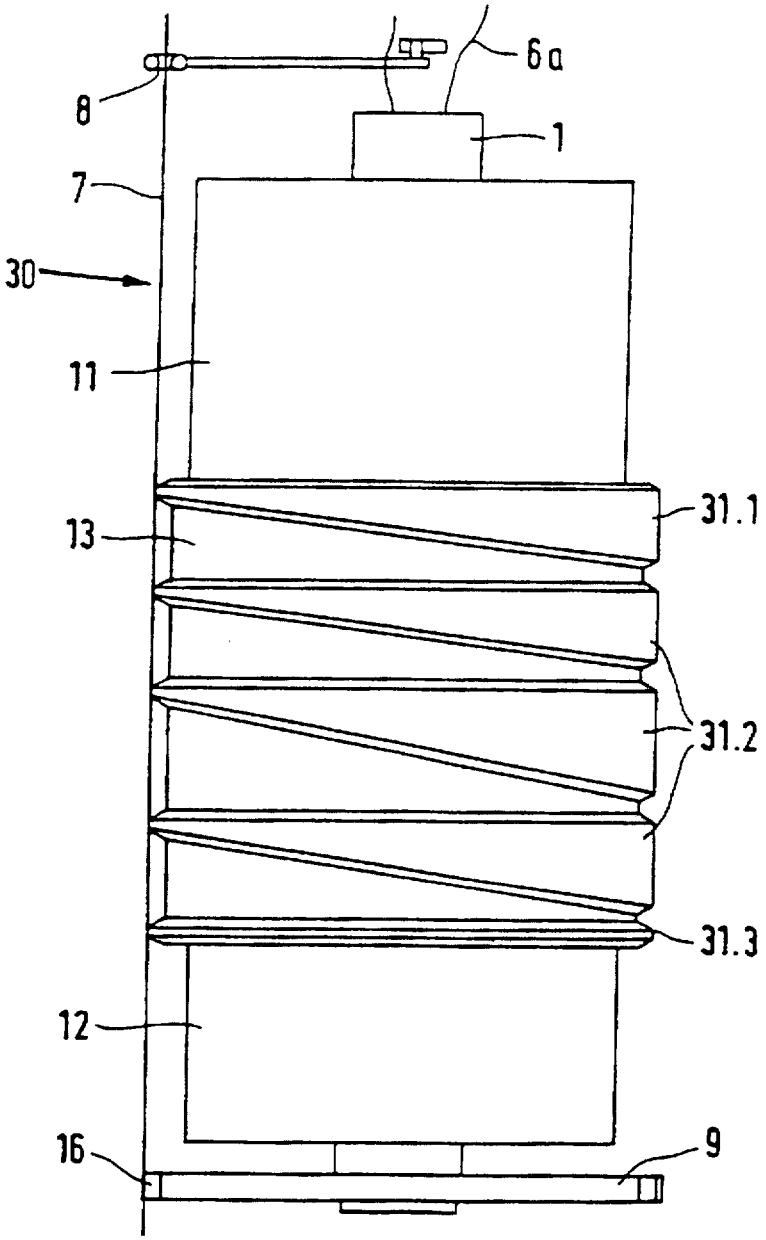
FIG. 18 is a modified embodiment of a tubular heater.

The following description of the Figures relates in particular to FIGS. 16–18. Wherever the Figures require a special description, such will be expressly noted.

The heating apparatus is used preferably in a false twist crimping machine. Such a false twist crimping machine is described, for example, in DE-PS 37 19 050, and comprises a plurality of feed yarn packages, from which a plurality of yarns are unwound, heating devices, over which each yarn advances, cooling devices, over which each yarn advances, a false twist unit, which imparts to the yarn a temporary twist, as well as feed and delivery rolls, which withdraw the yarn from the supply packages, or from the false twist unit. Subsequently, each yarn is wound on a takeup package. The illustrated heating devices refer to the aforesaid heater, which is arranged in the false twist zone.

The illustrated heating devices 30 are tubular. The yarn 7 advances first through an inlet yarn guide 8 and contacts then the circumference of the tube. The yarn is guided over the tube with an axial and with circumferential components by a yarn guide 9 at the outlet end. The yarn guide 9 is a disk rotatable about the tube axis and has a yarn guide notch 16. FIGS. 16 and 18 show, in a simplified manner, an aligned position of inlet yarn guide 8 and notch 16. FIG. 17 shows—as can be applied likewise to the embodiment of FIG. 18—that disk 9 is rotated such that the yarn, as aforesaid, is guided over the tube both with an axial and with circumferential components, thereby describing a steep helix. The rotation of disk 9 allows to adjust the looping of the yarn about the tube in circumferential direction. The looping is synonymous with a curvature of the yarn. Therefore, the looping permits the yarn to totally contact the tube or the yarn carriers attached thereto. These yarn carriers are described in more detail below.

The heating device consists of three sections, namely an inlet zone 11, a control zone 13, and an outlet zone 12. Above inlet zone 11, the yarn advances through inlet yarn guide 8, as well as a first yarn carrier 31.1 of control zone 13. In this region, the heating surface directed to the yarn, i.e., the jacket of inlet zone 11, assumes from the yarn a distance which amounts to a multiple of the distance that the yarn assumes from the heating surface, i.e., the axial surface ranges of control zone 13 extending between yarn carriers 31. The spacing between yarn guide 8 from the first yarn carrier 31.1 of the control zone amounts likewise to a multiple of the spacing of the yarn carriers in the control zone. In the latter zone, lengths of up to 500 mm can be accepted. The length in this zone is greatly dependent on the tendency to vibrations. Preferably, the length of inlet section 11 is selected smaller, so as to permit an efficient preheating of the yarn.

The heating apparatus is heated by a resistance heater in the form of a heating tube 1. Indicated at 6*a* are the electrical supply lines of the resistance heater. The resistance heater is constructed as a heating cartridge 1, and extends over the entire length of the heating apparatus, i.e., over inlet zone 11, control zone 13, and outlet zone 12.

The temperature control system of the heating apparatus comprises a temperature sensor, which detects the effective actual temperature of control zone 13. This temperature is equalized. The control zone has therefore a very accurate temperature control.

Arranged in control zone 13 is a plurality of yarn carriers 31. All of these yarn carriers 31, including first yarn carrier 31.1 are constructed as ridges, which extend over the circumference of the control zone. These ridges have a certain predetermined distance and have a certain height over the remaining surface range of control zone 13. The number of the yarn carriers is determined by the tendency of the yarn to vibrate, as well as the heat transfer. The height of the ridges relative to the surface of the control zone is selected preferably small, and amounts at most to 3 mm. Preferably, it is smaller than 1.5 mm.

The yarn advances over the outer circumference of the yarn carriers. In so doing, the yarn contacts the outer circumference over a certain length. This length is likewise decisive for the heat transfer.

To protect the yarn, this length of contact is selected short, it being necessary to make a compromise with the requirements of the heat transfer. The axial distance of the yarn carrier influences likewise the heat transfer. As a whole, a ratio of contact length to spacing of yarn carriers of 1:5 may be applied. Preferably however, this ratio is smaller, in particularly smaller than 1:10.

The distance from the heating surface, i.e., the surface of the inlet zone, amounts to 3 to 10 times the height of ridges 31, but is preferably less than 10 times. With respect to this, the illustrations in the drawing are not in a true scale.

In the outlet zone, the yarn advances again over only few yarn carriers, namely outlet yarn carrier 31.3 of the control zone, as well as the aforesaid disk 9 with its yarn guide notch 16. The spacing between the yarn path and the surface of outlet zone 12 is again by a multiple larger than the height of yarn guide ridges 31 relative to the surface of the control zone. Also in this instance, the same rules of proportioning apply as to inlet zone 11. As a whole, however, the spacing of the yarn carriers in the outlet zone is smaller than in the inlet zone. The spacing of the yarn guides amounts to 300 mm and is preferably smaller. It should be mentioned, that in practice the illustrated heating apparatus is enclosed by an insulating cage, which has a slot for threading the yarn, and which forms a peripheral gap or passage relative to the control zone, in which the yarn is guided. It is also possible to heat two yarns on one heating apparatus by arranging one pair each of inlet yarn guides 8 and yarn guide notches 16 in disk 9.

If possible, yarn guide inlet 8 has no contact with the heating apparatus, thus preventing yarn guide 8 from being heated. Therefore, also absent is a formation of sediments on yarn guide 8, which develop when the yarn is heated. As aforesaid, the outlet yarn guide of inlet zone 11 is the first yarn carrier 31.1 of control zone 13. It is a ridge as are the remaining yarn carriers 31.1, 31.2, 31.3 of the control zone. These ridges are machined out of the jacket or surface of the control zone. They are therefore in a highly heat-conductive contact with the heating apparatus. Their small height ensures that the control temperature is also present in the contact surfaces, thereby guaranteeing that the heater temperature, which is higher than 300° C., and selected so high that adhering yarn remnants are caused to crack and burn, exists even in the contact surfaces of ridges 31.1, 31.2, 31.3. Therefore, these yarn carriers have good selfcleaning properties.

The outlet yarn guide, i.e., disk 9 with yarn guide notch 16, is arranged for rotation on cartridge 1 of the heating apparatus. As a result, it is ensured that the temperatures in heating cartridge 1 extend likewise to disk 9, so that good selfcleaning effects can be expected at this end.

A special characteristic of the embodiment of FIG. 18 is the circumferential configuration of the ridges serving as yarns carriers 31.1, 31.2 and, possibly, 31.3. In the circumferential direction, the ridges have an increasing axial extension, the narrowest location, as one might note from FIG. 18, being not exactly on a surface line, but essentially on a line, which is substantially parallel to the contact line of the yarn, it being possible to change this contact line of the yarn. In so doing, it will be necessary to select a contact line corresponding to normal operating conditions. It will then be possible to rotate in FIG. 18 about the axis of the heating apparatus not only the outlet yarn guide in the form of disk 9 with yarn guide notch 16, but also inlet yarn guide 8. This allows to shift the yarn path on the circumference of the heating apparatus to a range, in which the contact length of the yarn guide ridges 31 has a desired dimension, and in which there is a desired ratio of contact length to unsupported guide length between the ridges. This allows to influence the heat transfer and, likewise, the smooth run of the yarn. On the other hand, a too great contact length will lead to considerable yarn frictions, which is undesired for the protection of the yarn.

Figure 19:
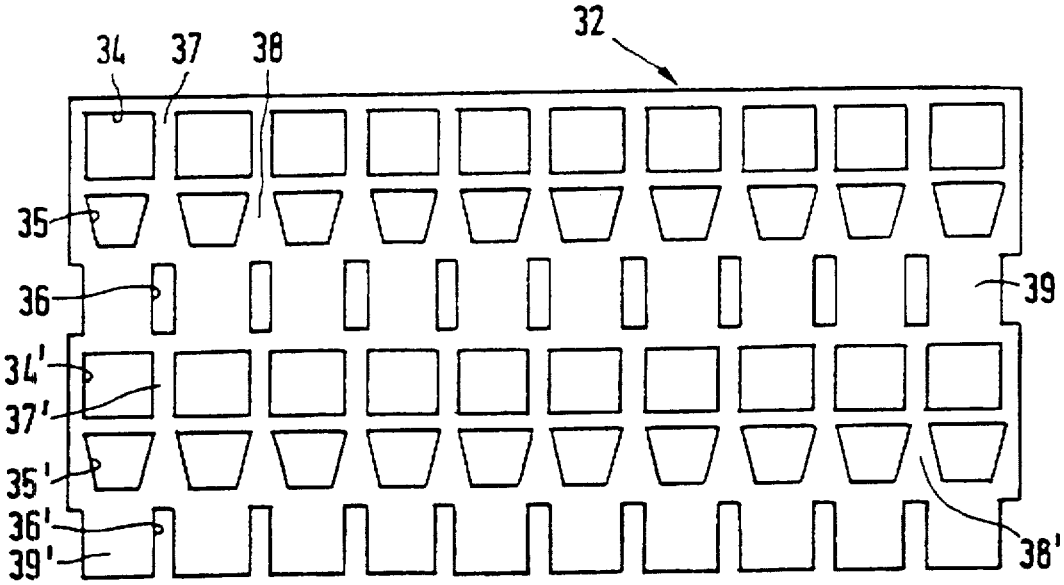
FIG. 19 is a top view of the blank of a yarn guide sleeve in its unrolled state with three pairs of different yarn guide ridges.

Shown in FIG. 19 is a blank 32 of a sleeve 33 in its unrolled state, which contains successively lined-up recesses 34, 35, 36, 34', 35', 36'. The recesses of each row are of the same shape and equally spaced apart. Formed between the recesses are ridges 37, 38, 39, 37', 38', and 39', which extend transversely to the blank and will be described in more detail below. The connecting ridges extending in the axial direction of blank 32 between each row of recesses are not relevant for the essence of the invention.

Figure 20:
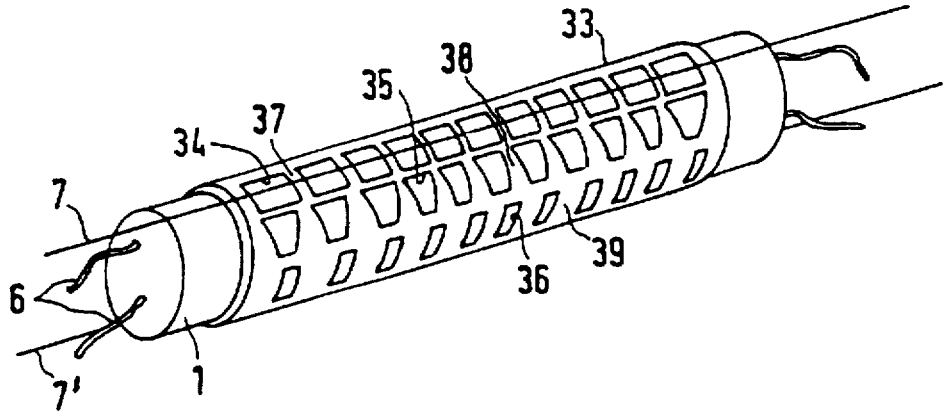
FIG. 20 is a perspective view, scaled down, of a heating tube with a sleeve slipped thereover.

As shown in FIG. 20, the blank 32 of FIG. 19 may be formed to a hollow cylinder and be slipped as such over a heating tube 1, the inside diameter of the hollow cylinder corresponding to the outside diameter of the heating tube. The cylinder, hereafter sleeve 33, is secured on heating tube 1 against axial displacement, but can be rotated about same, its rotation, if necessary, being dependent on the release of a blocking device known per se, but not illustrated in the Figure. In the illustrated embodiment, the recesses 34 extend in a line parallel to the axis of heating tube 1, and form between them equally wide ridges 37. The ridges 37 serve as guide ridges for a yarn 7 (which other than shown in the Figure for the sake of simplification, advances in a spiral along the cylinder), and are equally wide. The fact that sleeve 33 can be rotated about heating tube 1, offers the possibility of having yarn 7 advance over the circumferentially extending range of ridges 37, each time over a clean place, thereby further increasing the selfcleaning effect of the ridges, which is given per se in accordance with the above-described temperatures. The line of recesses 34' shown in FIG. 19 is diametrically opposite to recesses 34, and serves as a yarn path for a second yarn 7'.

Adjacent to the line of recesses 34 is a line of trapezoidal recesses 35, between which wedge-shaped ridges 38 extend. Diametrically opposite to this line is an identical arrangement of trapezoidal recesses 35' and wedge-shaped ridges 38'. Thus, it is possible to change the length of the heating surfaces being in contact with the yarn by a simple rotation of sleeve 33 about heating tube 1.

Finally, the illustrated embodiment of sleeve 33 is provided with a further variant of lined-up recesses 36. Same are recesses that a relatively small in axial direction, but leave wide connecting ridges 39 between them, which offer as yarn guide ridges a larger heating surface to a yarn 7. Corresponding to the other recesses, also in the case recesses 36 a diametrically opposite line of recesses 36' with corresponding ridges 39' is provided, which form a second yarn guide path.

The radial spacing between the surface of heating tube 1 and the surface of the ridges corresponds to the aforesaid dimensions, and is in a preferred range from 0.5 to 5 mm, preferably 0.50 to 3 mm.

The sleeve 33 may be provided with differently shaped recesses, so as to meet with specific operating conditions.

Figure 21:
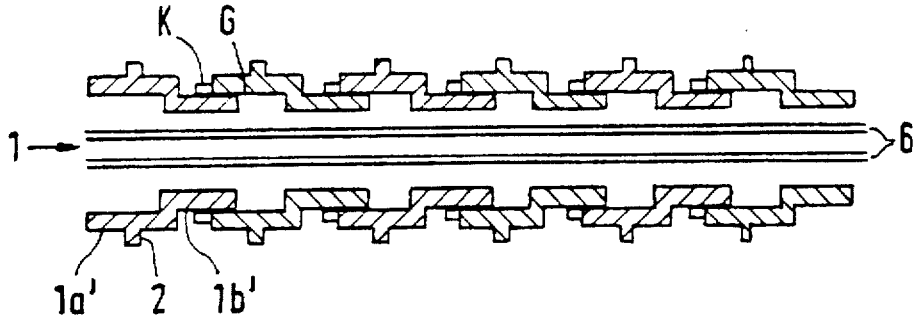
FIG. 21 is an axial sectional view of a heating tube comprising several sections adjustable relative to one another.
Figure 22:
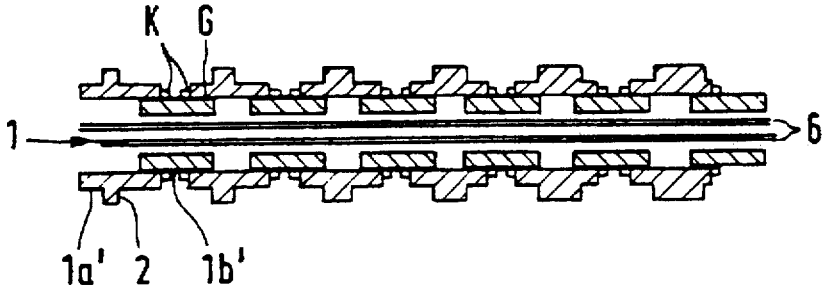
FIG. 22 is an axial sectional view of another heating tube consisting of sections.

Further embodiments of the invention are shown in FIGS. 21 and 22. Common to these embodiments is that the tubes 1 carrying the yarn guide ridges or rings 2. are composed of sections.

In the embodiment of FIG. 21, the sections consist each of a segment 1a' having a larger diameter and a segment 1b' having a smaller diameter, the latter corresponding to the inside diameter of segment 1a' with the larger outside diameter. Suitably, threads G are cut into the inner surface of segment 1a' with the larger outside diameter, and into the outer surface of segment 1b' with the smaller outside diameter. These threads allow to interconnect the individual tube sections. If need be, the screw connections may be secured by counternuts K, thus permitting a precise adjustment of the position of sections relative to one another.

Provided on the outer circumference of each segment 1a' with the larger diameter is a yarn carrier 2, which may be designed and constructed in accordance with the above-described embodiments, but is schematically indicated as a simple ring 2 in FIG. 21. The ring 2 may surround segment 1a' coaxially or, however, it may also be arranged off center. It may have an identical width over its entire circumference, or gradually or stepwise increasing widths. The outer surface of ring 2 may be interrupted by at least one axial groove (not shown), thus forming on tube 1 by a corresponding adjustment of rings 2, in addition to the spacings between rings 2, zones, which are not contacted by an advancing yarn 7.

With a corresponding configuration of rings 2, this embodiment of the invention has the advantage that by the rotation of tube sections, depending on the width of the individual rings 2 and their spacing between one another, it becomes possible to vary yarn contact lengths and contact-free zones within wide ranges.

Moreover, in the sense of the above-described embodiments, it is further possible to make the circumference of rings 2 eccentric to the axis of sections, or to provide steps over the circumference, so as to guide yarn 7 at a variable distance from the surface of sections. Otherwise, reference is made to the embodiments of FIGS. 1–20.

The embodiment shown in FIG. 22 differs from that of FIG. 21 in that it is provided in the place of stepped tube section, with internal and external sleeves 1b' and 1a' respectively, which can be screwed together by means of outside or inside threads and be secured in their position, if need be, by counternuts K. The outer sleeves 1a' are provided each on their surface with a ring 2 serving as a yarn carrier, the rings 2 being illustrated by way of example with a width that increases continuously in the axial direction of the tube consisting of sleeves 1b' and 1a'.

Otherwise, the foregoing description of the other embodiments applies likewise to this embodiment of heating apparatus and its yarn guides regardless of their configuration.

The present invention enables the optimal use of self-cleaning properties of a heating apparatus with a simultaneously good heating behavior, in particular in false twist crimping machines.

We claim:

1. An apparatus for heating an advancing yarn, comprising an elongate tubular heating surface, means for heating the heating surface, and yarn guide means comprising a plurality of yarn carriers mounted in a longitudinally spaced apart arrangement along the length of the heating surface, and such that the yarn carriers define relatively short axial ranges which directly contact the yarn and thereby directly heat the same, and axial ranges between the yarn carriers which are not in contact with the yarn and wherein the yarn is heated by radiation, and with the yarn carriers being thermally connected to the heating surface and constructed so that in operation they assume approximately the same temperature as that of the heating surface, and wherein the tubular heating surface and the yarn carriers are formed of at the most the number of pieces corresponding to the number of yarn carriers.

2. The apparatus as defined in claim 1 wherein the means for heating the heating surface heats the heating surface and the yarn carriers to a temperature sufficient for self-cleaning.

3. The apparatus as defined in claim 1 wherein the height of the yarn carriers ranges from 0.5 to 3 mm above the heating surface.

4. The apparatus as defined in claim 1 wherein the heating surface includes a plurality of axially spaced apart grooves, with the yarn carriers being defined between adjacent grooves.

5. The apparatus as defined in claim 1 wherein the elongate heating surface defines a yarn inlet end and a yarn outlet end, and further comprising a yarn guide at each of said inlet and outlet ends, with the yarn guides being adjustable relative to one another in a direction transverse to the direction of the advancing yarn.

6. The apparatus as defined in claim 1 wherein the yarn carriers are configured so as to provide varying lengths of contact between the advancing yarn and the yarn carriers.

7. The apparatus as defined in claim 1 wherein the length of contact between the advancing yarn and at least one of the yarn carriers is adjustable.

8. The heating apparatus as defined in claim 1 wherein the height of at least one of the yarn carriers from the heating surface varies in a direction transverse to the direction of the advancing yarn.

9. The heating apparatus as defined in claim 1 wherein the length of the axial range between at least two adjacent yarn carriers varies in a direction transverse to the direction of the advancing yarn.

10. The heating apparatus as defined in claim 1 wherein the yarn carriers are formed from a single material with the heating surface.

11. The heating apparatus as defined in claim 1 wherein the yarn carriers are adjustable with respect to the heating surface in a direction transverse to the direction of the advancing yarn.

12. The apparatus as defined in claim 1 wherein the yarn carriers are adjustable with respect to the heating surface in a direction parallel to the direction of the advancing yarn.

13. The heating apparatus as defined in claim 1 wherein the tubular heating surface is rotatable about its axis.

14. The heating apparatus as defined in claim 1 wherein the circumferential surfaces of the yarn carriers are eccentric with respect to the axis of the tubular heating surface.

15. The heating apparatus as defined in claim 1 wherein the yarn carriers are annular and arranged for rotation with respect to the axis of the tubular heating surface.

16. The heating apparatus as defined in claim 1 wherein the yarn carriers are mounted for axial adjustment.

17. The heating apparatus as defined in claim 1 wherein the yarn carriers comprise a sleeve disposed coaxially over the tubular heating surface, with the sleeve being perforated.

18. The heating apparatus as defined in claim 17 wherein the perforations form a plurality of circumferentially adjacent rows which extend in the axial direction of the sleeve and wherein the perforations of each row are of uniform configuration.

19. The apparatus as defined in claim 1 wherein the elongate heating surface comprises two axial sections composed of an inlet zone and an intermediate zone, and wherein the inlet zone has either no yarn carriers or relatively widely spaced yarn carriers, and the intermediate zone has relatively closely spaced apart yarn carriers.

20. The apparatus as defined in claim 1 wherein the elongate heating surface comprises three axial sections, composed of an inlet zone have either no yarn carriers or relatively widely spaced apart yarn carriers, an intermediate zone in which the yarn carriers are relatively closely spaced apart, and an outlet zone having either no yarn carriers or relatively widely spaced apart yarn carriers.

21. An apparatus for heating an advancing yarn, comprising an elongate heating surface, means for heating the heating surface, and yarn guide means comprising a plurality of yarn carriers mounted in a longitudinally spaced apart arrangement along the length of the heating surface, and such that the yarn carriers define relatively short axial ranges which directly contact the yarn and thereby directly heat the same, and axial ranges between the yarn carriers which are not in contact with the yarn and wherein the yarn is heated by radiation, and with the yarn carriers being thermally connected to the heating surface and constructed so that in operation they assume approximately the same temperature as that of the heating surface, and wherein the length of the axial range between at least two adjacent yarn carriers varies in a direction transverse to the direction of the advancing yarn.

22. An apparatus for heating an advancing yarn, comprising an elongate heating surface, means for heating the heating surface, and yarn guide means comprising a plurality of yarn carriers mounted in a longitudinally spaced apart arrangement along the length of the heating surface, and such that the yarn carriers define relatively short axial ranges which directly contact the yarn and thereby directly heat the same, and axial ranges between the yarn carriers which are not in contact with the yarn and wherein the yarn is heated by radiation, and with the yarn carriers being thermally connected to the heating surface and constructed so that in operation they assume approximately the same temperature as that of the heating surface, and wherein the elongate heating surface comprises three axial sections, composed of an inlet zone have either no yarn carriers or relatively widely spaced apart yarn carriers, an intermediate zone in which the yarn carriers are relatively closely spaced apart, and an outlet zone having either no yarn carriers or relatively widely spaced apart yarn carriers.

23. An apparatus for heating an advancing yarn, comprising an elongate tubular heating surface, means for heating the heating surface, and yarn guide means comprising a plurality of yarn carriers mounted in a longitudinally spaced apart arrangement along the length of the heating surface, and such that the yarn carriers define relatively short axial ranges which directly contact the yarn and thereby directly heat the same, and axial ranges between the yarn carriers which are not in contact with the yarn and wherein the yarn is heated by radiation, and with the yarn carriers being thermally connected to the heating surface and constructed so that in operation they assume approximately the same temperature as that of the heating surface, and wherein the heating surface includes a plurality of axially spaced apart grooves, with the yarn carriers being defined between adjacent grooves.

24. An apparatus for heating an advancing yarn, comprising an elongate tubular heating surface, means for heating the heating surface, and yarn guide means comprising a plurality of yarn carriers mounted in a longitudinally spaced apart arrangement along the length of the heating surface, and such that the yarn carriers define relatively short axial ranges which directly contact the yarn and thereby directly heat the same, and axial ranges between the yarn carriers which are not in contact with the yarn and wherein the yarn is heated by radiation, and with the yarn carriers being thermally connected to the heating surface and constructed so that in operation they assume approximately the same temperature as that of the heating surface, and wherein the yarn carriers are formed from a single material with the heating surface.

25. An apparatus for heating an advancing yarn, comprising an elongate tubular heating surface, means for heating the heating surface, and yarn guide means comprising a plurality of yarn carriers mounted in a longitudinally spaced apart arrangement along the length of the heating surface, and such that the yarn carriers define relatively short axial ranges which directly contact the yarn and thereby directly heat the same, and axial ranges between the yarn carriers which are not in contact with the yarn and wherein the yarn is heated by radiation, and with the yarn carriers being thermally connected to the heating surface and constructed so that in operation they assume approximately the same temperature as that of the heating surface, and wherein the circumferential surfaces of the yarn carriers are eccentric with respect to the axis of the tubular heating surface.

26. An apparatus for heating an advancing yarn, comprising an elongate tubular heating surface, means for heating the heating surface, and yarn guide means comprising a plurality of yarn carriers mounted in a longitudinally spaced apart arrangement along the length of the heating surface, and such that the yarn carriers define relatively short axial ranges which directly contact the yarn and thereby directly heat the same, and axial ranges between the yarn carriers which are not in contact with the yarn and wherein the yarn is heated by radiation, and with the yarn carriers being thermally connected to the heating surface and constructed so that in operation they assume approximately the same temperature as that of the heating surface, and wherein the yarn carriers comprise a sleeve disposed coaxially over the tubular heating surface, with the sleeve being perforated.

27. The heating apparatus as defined in claim 26 wherein the perforations form a plurality of circumferentially adjacent rows which extend in the axial direction of the sleeve and wherein the perforations of each row are of uniform configuration.

28. An apparatus for heating an advancing yarn, comprising an elongate tubular heating surface, means for heating the heating surface, and yarn guide means comprising a plurality of yarn carriers mounted in a longitudinally spaced apart arrangement along the length of the heating surface, and such that the yarn carriers define relatively short axial ranges which directly contact the yarn and thereby directly heat the same, and axial ranges between the yarn carriers which are not in contact with the yarn and wherein the yarn is heated by radiation, and with the yarn carriers being thermally connected to the heating surface and constructed so that in operation they assume approximately the same temperature as that of the heating surface, and wherein each yarn carrier is formed from a single material with at least a segment of the elongate tubular heating surface.

29. The heating apparatus as defined in claim 28 wherein the elongate tubular heating surface comprises a plurality of tubular segments which are threadedly interconnected, and wherein each yarn carrier is formed from a single material with a respective one of the tubular segments.

* * * * *